US009215896B2

(12) United States Patent
Smith

(10) Patent No.: US 9,215,896 B2
(45) Date of Patent: Dec. 22, 2015

(54) BREAST SUPPORTING GARMENT

(75) Inventor: Cynthia A. Smith, Red Bank, NJ (US)

(73) Assignee: Lynx Enterprises LLC, New York, NY (US)

( * ) Notice: Subject to any disclaimer, the term of this patent is extended or adjusted under 35 U.S.C. 154(b) by 0 days.

(21) Appl. No.: 14/241,031

(22) PCT Filed: Aug. 31, 2012

(86) PCT No.: PCT/US2012/053396

§ 371 (c)(1),
(2), (4) Date: Feb. 25, 2014

(87) PCT Pub. No.: WO2013/033567

PCT Pub. Date: Mar. 7, 2013

(65) Prior Publication Data

US 2014/0230119 A1 Aug. 21, 2014

Related U.S. Application Data

(60) Provisional application No. 61/530,740, filed on Sep. 2, 2011.

(51) Int. Cl.

| | |
|---|---|
| ***A41C 3/00*** | (2006.01) |
| ***A41D 27/13*** | (2006.01) |
| ***A41C 5/00*** | (2006.01) |
| ***A41D 1/00*** | (2006.01) |
| ***A41D 3/02*** | (2006.01) |
| *A41D 7/00* | (2006.01) |

(52) U.S. Cl.

CPC ..... *A41C 3/00* (2013.01); *A41C 3/0014* (2013.01); *A41C 3/0057* (2013.01); *A41C 5/00* (2013.01); *A41D 1/00* (2013.01); *A41D 3/02* (2013.01); *A41D 27/133* (2013.01); *A41D 7/00* (2013.01)

(58) Field of Classification Search

CPC ..... A41D 7/00; A41D 27/133; A41D 15/00; A41C 1/06; A41C 3/08

USPC ..... 2/55, 67, 70, 105, 106, 107; 450/7, 31

See application file for complete search history.

(56) References Cited

U.S. PATENT DOCUMENTS

| | | | |
|---|---|---|---|
| 3,010,456 | A | 11/1961 | Jacobs et al. |
| 3,110,313 | A | 11/1963 | Plehn |
| 3,896,818 | A | 7/1975 | Locascio |
| 3,952,752 | A | 4/1976 | Huttle, Jr. |
| 4,217,905 | A | 8/1980 | Atwater et al. |

(Continued)

OTHER PUBLICATIONS

International Search Report on PCT/US2012/053396 dated Nov. 20, 2012.

(Continued)

*Primary Examiner* — Tejash Patel

(74) *Attorney, Agent, or Firm* — Foley & Lardner LLP; John D. Lanza

(57) ABSTRACT

A breast support device designed to provide the wearer with a high degree of control and support of breast tissue while minimizing the pain and discomfort associated with conventional breast control garments, that can be worn on its own or integrated into garments where breast support is desirable. The breast support device achieves these objectives through the innovative combination of various non-stretch and stretch fabrics, as well as through the use on one or more darts of varying length sewn into the non-stretch fabric.

38 Claims, 23 Drawing Sheets

(56) References Cited

U.S. PATENT DOCUMENTS

| | | | | |
|---|---|---|---|---|
| 4,254,777 | A | 3/1981 | Johnston | |
| 4,289,137 | A | 9/1981 | Dell et al. | |
| 4,340,064 | A | 7/1982 | Vale | |
| 4,458,684 | A | 7/1984 | Frankel | |
| 4,538,614 | A | 9/1985 | Henderson | |
| 4,781,651 | A | 11/1988 | Ekins | |
| 4,804,351 | A | 2/1989 | Raml et al. | |
| 4,816,005 | A | 3/1989 | Braaten | |
| 5,643,043 | A | 7/1997 | Pflum | |
| 6,287,168 | B1 | 9/2001 | Rabinowicz | |
| 6,443,805 | B1 * | 9/2002 | Kirkwood | 450/31 |
| 6,685,534 | B2 | 2/2004 | Mitchell et al. | |
| 6,846,217 | B1 * | 1/2005 | Struble et al. | 450/31 |
| 7,163,432 | B2 | 1/2007 | Mitchell et al. | |
| 7,435,155 | B2 | 10/2008 | Reinisch et al. | |
| 7,654,115 | B2 | 2/2010 | Duckham et al. | |
| RE41,654 | E | 9/2010 | Struble et al. | |
| 7,905,117 | B2 * | 3/2011 | Kronback | 66/176 |
| 7,938,711 | B1 | 5/2011 | Johnston | |
| 8,075,368 | B2 | 12/2011 | Puyaubreau | |
| 8,137,155 | B2 | 3/2012 | Horii et al. | |
| 8,257,138 | B2 | 9/2012 | Smith | |
| 2006/0009124 | A1 | 1/2006 | Falla | |
| 2007/0010165 | A1 | 1/2007 | Yudkoff | |
| 2008/0003922 | A1 | 1/2008 | Hori | |
| 2008/0070477 | A1 | 3/2008 | Barbour et al. | |
| 2008/0287036 | A1 | 11/2008 | McGuire | |
| 2009/0081924 | A1 | 3/2009 | Puyaubreau | |
| 2009/0098803 | A1 | 4/2009 | Reinisch et al. | |
| 2009/0233522 | A1 | 9/2009 | Schlatmann | |
| 2011/0081827 | A1 | 4/2011 | Williams | |
| 2011/0104985 | A1 | 5/2011 | Linder et al. | |
| 2011/0117818 | A1 | 5/2011 | Barnard | |
| 2011/0130072 | A1 | 6/2011 | Lander | |

OTHER PUBLICATIONS

Notice of Allowance on U.S. Appl. No. 12/717,416 dated May 9, 2012.

Notice of Allowance on U.S. Appl. No. 13/601,630 dated May 3, 2013.

Office Action on U.S. Appl. No. 12/717,416 dated Mar. 29, 2012.

Office Action on U.S. Appl. No. 13/601,630 dated Jan. 3, 2013.

Written Opinion on PCT/US2012/053396 dated Nov. 20, 2012.

International Preliminary Report on Patentability on PCT/US2012/053396 dated Mar. 13, 2014.

* cited by examiner

BREAST SUPPORTING GARMENT

RELATED APPLICATION

This present application is a U.S. National Stage of International Patent Application No. PCT/US2012/053396, entitled "Breast Supporting Garment," filed on Aug. 31, 2012, which claims the benefit of and priority to U.S. Provisional Patent Application No. 61/530,740, entitled "Breast Supporter," filed on Sep. 2, 2011. The entire contents of the foregoing applications are hereby incorporated herein by reference.

FIELD OF THE INVENTION

A breast support device to be worn by women that provides a high degree of control and support of breast tissue while minimizing the pain and discomfort associated with conventional breast control garments.

BACKGROUND OF THE INVENTION

In order to protect and support fragile breast tissue, both during athletic pursuits and everyday life, women must wear a garment that provides them with a high level of breast tissue support. Without sufficient support, many women experience physical pain in their breasts as well as permanent damage to their breast tissue.

However, many garments which provide a high level of support to breast tissue utilize shoulder straps to bear a majority of the weight of the breasts. This method of support often causes shoulder and neck pain. Other breast control garments utilize a tight rib band to support the breasts from underneath the breast tissue. Because this method of support depends on the tightness of the band around the wearer's torso, this method of support often causes pain to the torso and restricts breathing. Still other methods of breast control rely primarily on compression of the breasts toward the chest wall. This method of support squashes the breasts into the torso, causing discomfort, breathing restriction and an unflattering profile. Other methods of support employ molded cups to provide support to the breast tissue. This method of support fails to provide a high level of support to breast tissue and is unable to conform to the breast shape of the wearer. Still other methods of breast support rely on a combination of two or more of these methods of support.

Numerous activities exist that require women to be active while wearing garments that provide inadequate breast support. These activities include, but are not limited to, dance, figure skating, gymnastics, swimming, lifeguarding. As a result of this inadequate breast support, many women, especially those with a breast size of C-cup or greater, are excluded from participating in these activities.

With the increasing number of physically active women and the increase in the average cup size of the American woman to a 36DD, breast support garments that provide women with sufficient breast support without undue discomfort or restrictions on movement or breathing are integral to women's successful participation in numerous activities.

BRIEF SUMMARY OF THE INVENTION

The object of the breast supporter is to provide women with a breast support device that provides a high degree of control and support of breast tissue while minimizing the pain and discomfort associated with conventional breast control garments, that can be worn on its own or integrated into garments where breast support is desirable. These objects are achieved through the innovative combination of various non-stretch and stretch fabrics, as well as through the use on one or more darts of varying length sewn into the non-stretch fabric. The non-stretch portions of the garment provide a high level of compression and stability to the breast tissue, while the multiple regions of stretch fabric minimize breathing, shoulder restrictions and other physical discomforts currently associated with conventional breast support garments. The use of one or more darts of varying size assists in creating a desired three-dimensional space in the non-stretch fabric to receive the breast. Omitting darts or utilizing one or more darts of various size can assist in creating different volumes of three-dimensional space so as to suit a bulged shape of a breast. It is understood that any mechanism known to those skilled in the art can be employed in place of the dart to provide depth where it is desired.

In the present invention, non-stretch fabric is used to form the majority of the body breast support device, and is used to firmly hold the breast tissue in a stable position. This non-stretch fabric is connected to panels of stretch wicking fabric located in the front and back of the body of the bra. These panels allow the otherwise rigid body of the bra to expand horizontally with the chest as the wearer inhales and exhales, providing the wearer with a great degree of comfort and range of motion without sacrificing motion control of the breast tissue.

In one aspect, the breast support device comprises a body configured to contact a wearer's torso wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material.

In another aspect, the breast support device comprises a body configured to contact a wearer's torso and a rib band, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material.

In another aspect, the breast support device comprises one or two shoulder straps, a body configured to contact a wearer's torso, wherein said shoulder strap or shoulder straps are connected to the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material.

In another aspect, the breast support device comprises one or two shoulder straps, a body configured to contact a wearer's torso, and a rib band, wherein said shoulder strap or shoulder straps are connected to the body, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material.

In another aspect, the breast support device comprises a body configured to contact a wearer's torso wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast.

In another aspect, the breast support device comprises a body configured to contact a wearer's torso, and a rib band, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast.

In another aspect, the breast support device comprises one or two shoulder straps, a body configured to contact a wearer's torso, wherein said shoulder strap or shoulder straps are connected to the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast.

In another aspect, the breast support device comprises one or two shoulder straps, a body configured to contact a wearer's torso, and a rib band, wherein said shoulder strap or shoulder straps are connected to the body, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast.

In another aspect, the breast support device comprises a body configured to contact a wearer's torso wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material wherein the border between stretch fabric pieces and non-stretch fabric pieces is irregular.

In another aspect, the breast support device comprises a body configured to contact a wearer's torso, and a rib band, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material wherein the border between stretch fabric pieces and non-stretch fabric pieces is irregular.

In another aspect, the breast support device comprises one or two shoulder straps, a body configured to contact a wearer's torso, wherein said shoulder strap or shoulder straps are connected to the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material wherein the border between stretch fabric pieces and non-stretch fabric pieces is irregular.

In another aspect, the breast support device comprises one or two shoulder straps, a body configured to contact a wearer's torso, and a rib band, wherein said shoulder strap or shoulder straps are connected to the body, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein the right edge of the front center panel and the left edge of the back center panel are connected to one another by one or more contiguous fabric pieces constructed of non-stretch material wherein the border between stretch fabric pieces and non-stretch fabric pieces is irregular.

In another aspect, the breast support device comprises a body configured to contact a wearer's torso wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast wherein the border between stretch fabric pieces and non-stretch fabric pieces is irregular.

In another aspect, the breast support device comprises a body configured to contact a wearer's torso, and a rib band, wherein the rib band is associated with the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast wherein the border between stretch fabric pieces and non-stretch fabric pieces is irregular.

In another aspect, the breast support device comprises one or two shoulder straps, a body configured to contact a wearer's torso, wherein said shoulder strap or shoulder straps are connected to the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast wherein the border between stretch fabric pieces and non-stretch fabric pieces is irregular.

In another aspect, the breast support device comprises one or two shoulder straps, a body configured to contact a wearer's torso, and a rib band, wherein the rib band is associated with the body, wherein said shoulder strap or shoulder straps are connected to the body, wherein said body is comprised of: a front center panel constructed of stretch material and a back center panel constructed of stretch material, wherein the left edge of the front center panel and the right edge of the back center panel are connected to one another by one or more contiguous fabric pieces constructed of non-stretch material wherein said contiguous fabric pieces constructed of non-stretch material include one or more darts such that the point of said dart or darts is oriented toward the center portion of the wearer's breast, wherein the right edge of the front center panel and the left edge of the back center panel are connected to one another by one or more contiguous fabric pieces constructed of non-stretch material, wherein said contiguous fabric pieces constructed of non-stretch material include one or more darts such that the point of said dart or darts is oriented toward the center portion of the wearer's breast wherein the border between stretch fabric pieces and non-stretch fabric pieces is irregular.

Other configurations, features and advantages of the invention will be, or will become, apparent to one with skill in the art upon examination of the following figures and detailed description. It is intended that all such additional configurations, features and advantages included within this description and this summary, be within the scope of the invention, and be protected by the following claims.

BRIEF DESCRIPTION OF THE DRAWINGS

The present invention can be understood more clearly with reference to the following drawings and description. The components in the drawings are not necessarily to scale, emphasis is instead placed on illustration of the principles of the invention. In the drawings.

DETAILED DESCRIPTION

Figure 1:
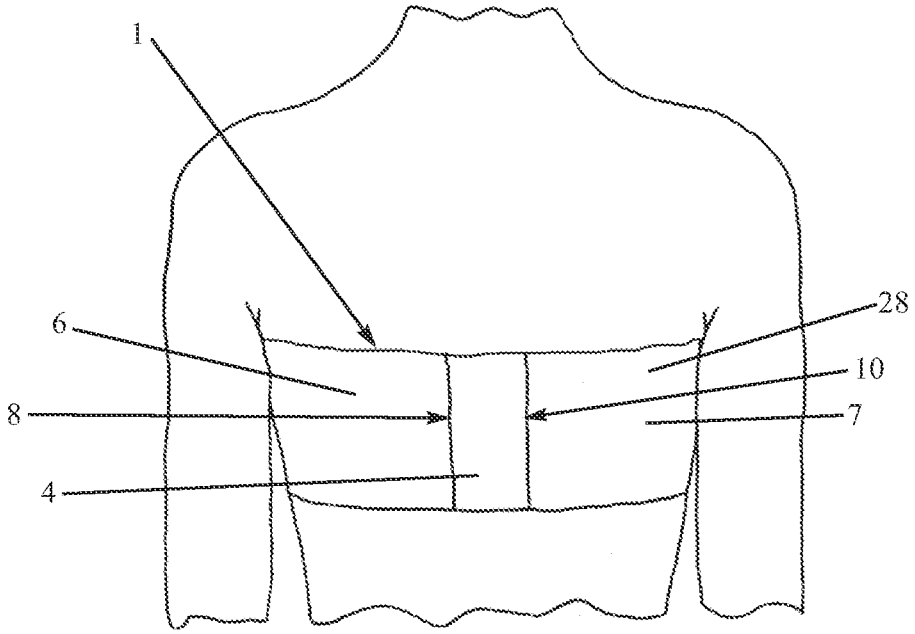
FIG. 1 is a front elevational view of a breast support device in accordance with a first embodiment of the present invention shown on the wearer.
Figure 2:
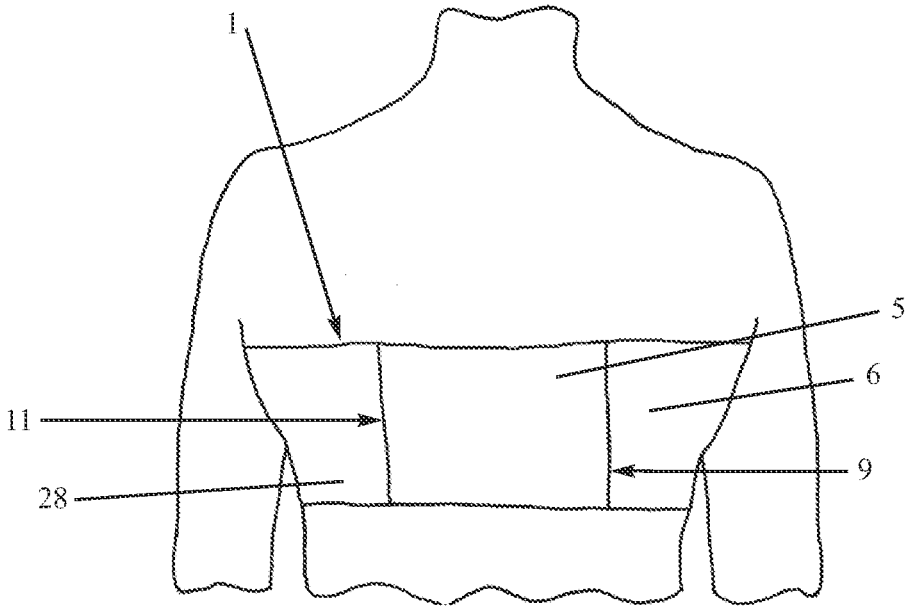
FIG. 2 is a rear elevational view of the breast support device according to FIG. 1.

In FIG. 1 and FIG. 2, breast support device 1 comprises a body 7 configured to contact a wearer's torso. The body 7 is comprised of a front center panel 4, a back center panel 5 and one or more fabric pieces 6 and 28 connecting the front center panel 4 and the back center panel 5. Specifically, the left edge 8 of the front center panel 4 and the right edge 9 of the back center panel 5 are connected to one another by one or more fabric pieces 6, and the right edge 10 of the front center panel 4 and the left edge 11 of the back center panel 5 are connected to one another by one or more fabric pieces 28.

Figure 3:
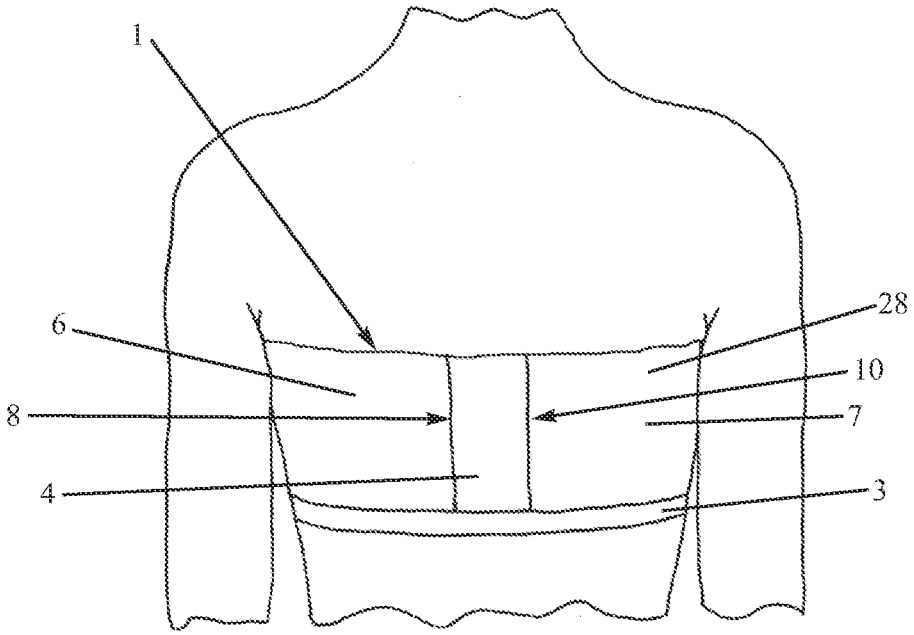
FIG. 3 is a front elevational view of the breast support device in accordance with a second embodiment of the present invention shown on the wearer.
Figure 4:
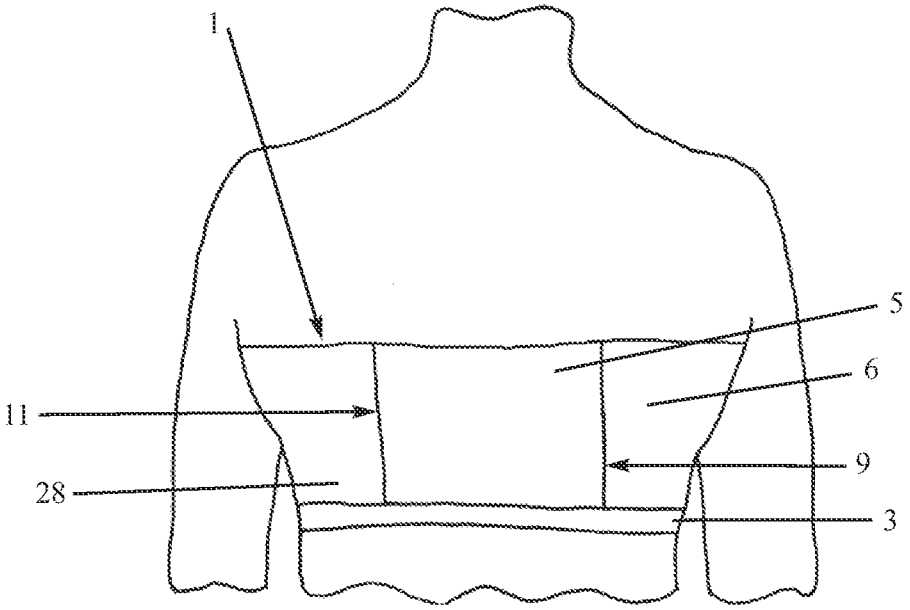
FIG. 4 is a rear elevational view of a breast support device according to FIG. 3.

In FIG. 3 and FIG. 4, breast support device 1 comprises a body 7 configured to contact a wearer's torso and a rib band 3. The rib band 3 is associated with the body 7. The body 7 is comprised of a front center panel 4, a back center panel 5 and one or more fabric pieces 6 and 28 connecting the front center panel 4 and the back center panel 5. Specifically, the left edge 8 of the front center panel 4 and the right edge 9 of the back center panel 5 are connected to one another by one or more fabric pieces 6, and the right edge 10 of the front center panel 4 and the left edge 11 of the back center panel 5 are connected to one another by one or more fabric pieces 28.

Figure 5:
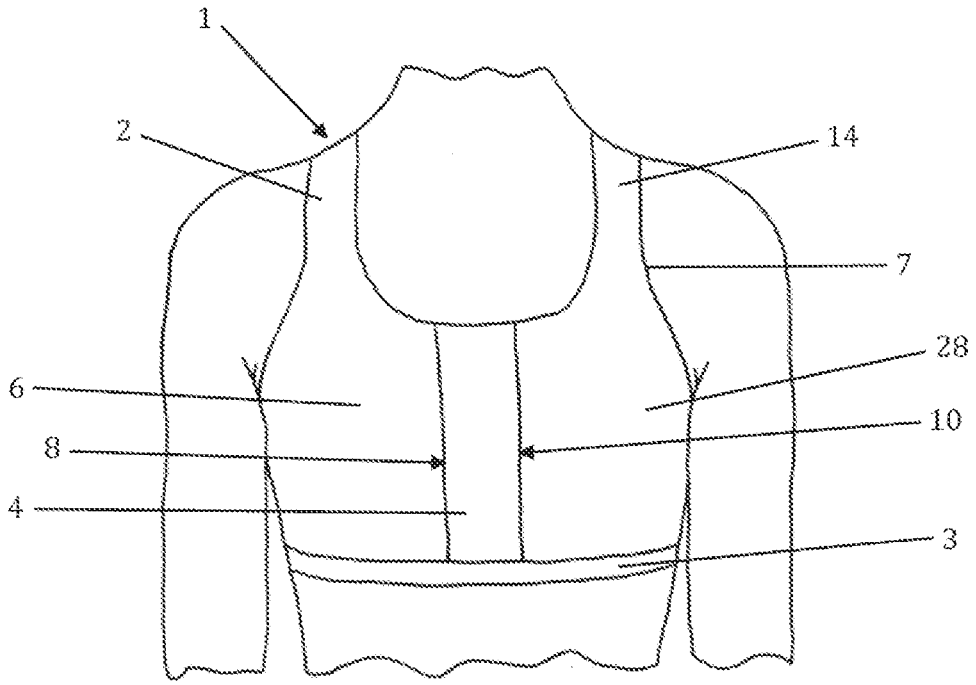
FIG. 5 is a front elevational view of the breast support device in accordance with a third embodiment of the present invention shown on the wearer.
Figure 6:
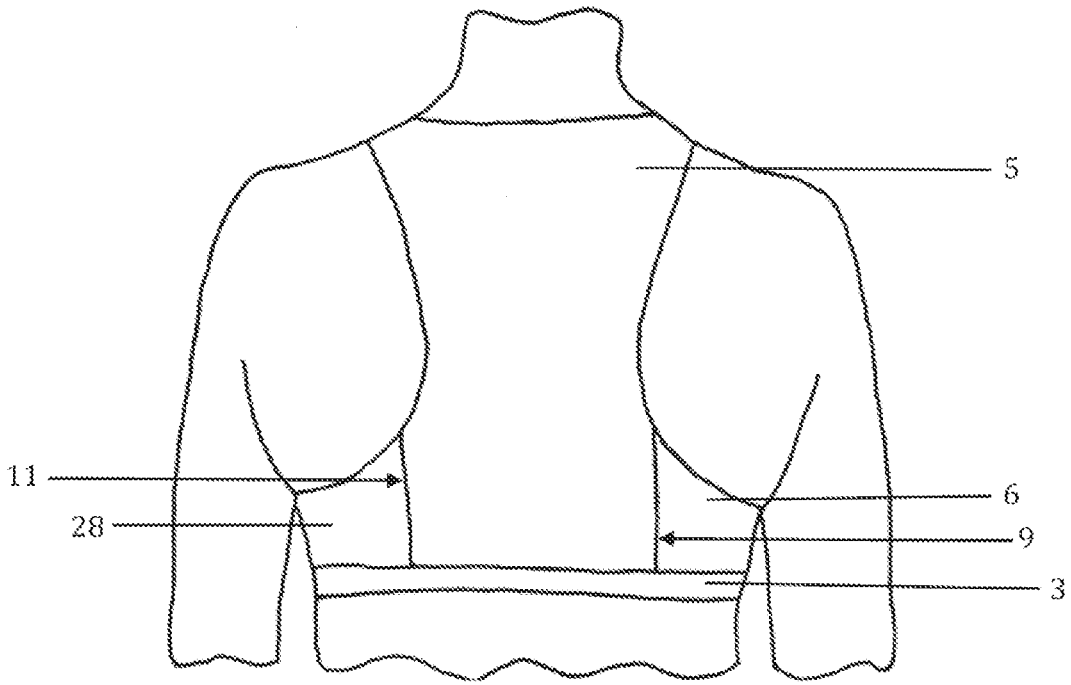
FIG. 6 is a rear elevational view of a breast support device according to FIG. 5.

In FIG. 5 and FIG. 6, breast support device 1 comprises two shoulder straps 2 and 14, a body 7 configured to contact a wearer's torso and a rib band 3. The shoulder straps 2 and 14 are connected to the body 7. The rib band 3 is associated with the body 7. The body 7 is comprised of a front center panel 4, a back center panel 5 and one or more fabric pieces 6 and 28 connecting the front center panel 4 and the back center panel 5. Specifically, the left edge 8 of the front center panel 4 and the right edge 9 of the back center panel 5 are connected to one another by one or more fabric pieces 6, and the right edge 10 of the front center panel 4 and the left edge 11 of the back center panel 5 are connected to one another by one or more fabric pieces 28.

Figure 7:
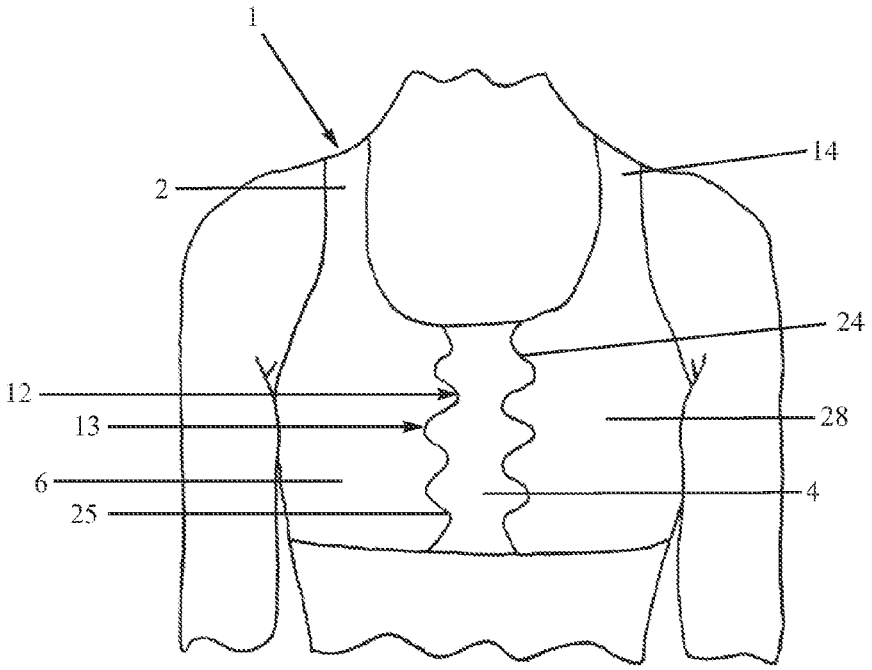
FIG. 7 is a front elevational view of a breast support device in accordance with a fourth embodiment of the present invention shown on the wearer.
Figure 8:
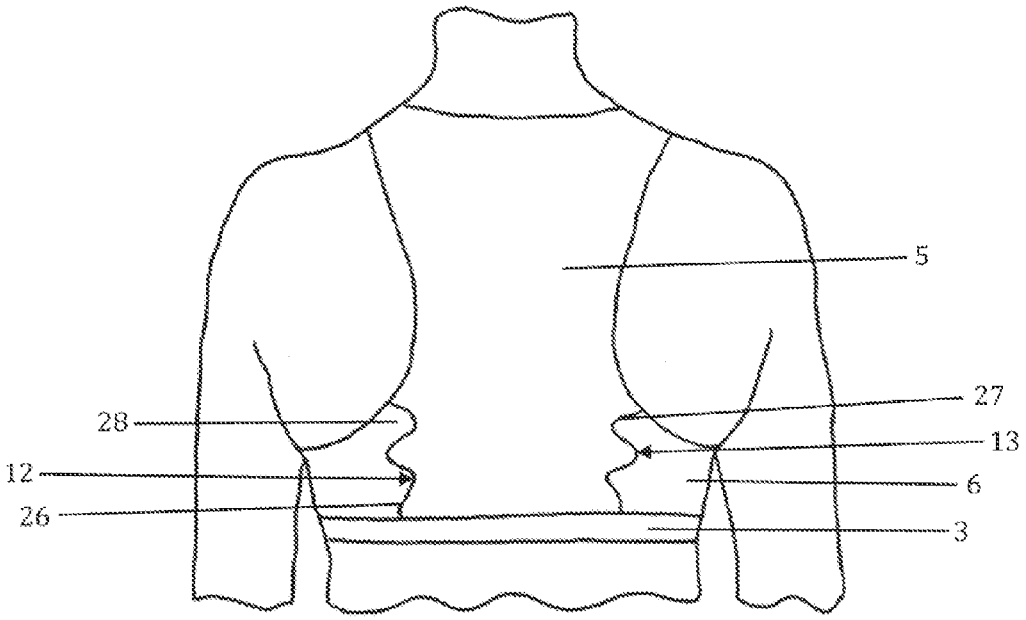
FIG. 8 is a rear elevational view of a breast support device in accordance with a fifth embodiment of the present invention shown on the wearer.
Figure 9:
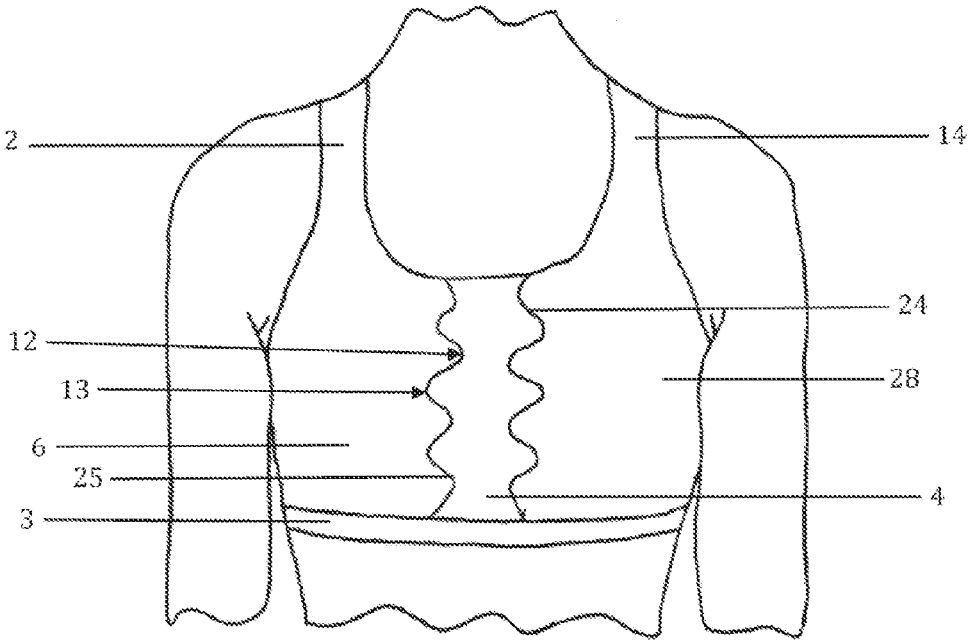
FIG. 9 is a front elevational view of a breast support device according to FIG. 8.

FIG. 7, FIG. 8 and FIG. 9 show further embodiments, where borders 24, 25, 26 and 27 between front center panel 4 and the plurality of fabric pieces 6 and 28 and the back center panel 5 and the plurality of fabric pieces may be irregular, meaning that the seams 24, 25, 26 and 27 between the non-stretch 6 and 28 and stretch 4 and 5 portions of the body 7 of the bra are non-linear. This irregular border 24, 25, 26 and 27 can allow the amount of support to be greater where the non-stretch protrusions 12 of fabric are closer together and the amount of stretch to be greater where the non-stretch protrusions 13 of fabric are farther apart, providing additional breast tissue support without decreasing ventilation. It is within the scope of the present invention that the shape of the irregular border 24, 25, 26 and 27 can vary to include a variety of shapes and designs.

The fabric pieces 6 and 28 connecting the front center panel 4 and the back center panel 5 are constructed of non-stretch material. When used herein, "non-stretch material," means a material with no elastic components such that any limited stretch exhibited by the fabric is a result of mechanical movement in the weave of the fabric. In some embodiments, fabric pieces 6 and 28 of the breast support device 1 may be nylon. In other embodiments, fabric pieces 6 and 28 of the breast support device 1 may be polyester. In other embodiments, fabric pieces 6 and 28 of the breast support device 1 may be cotton. In still other embodiments, fabric pieces 6 and 28 of the breast support device 1 may be wool. In other embodiments, fabric pieces 6 and 28 of the breast support device 1 may be silk. In other embodiments, fabric pieces 6 and 28 of the breast support device 1 may be acrylic. In other embodiments, fabric pieces 6 and 28 of the breast support device 1 may be acetate. In still other embodiments, fabric pieces 6 and 28 of the breast support device 1 may be rayon. In still other embodiments, fabric pieces 6 and 28 of the breast support device 1 may be a combination of two or more of these materials.

Figure 10:
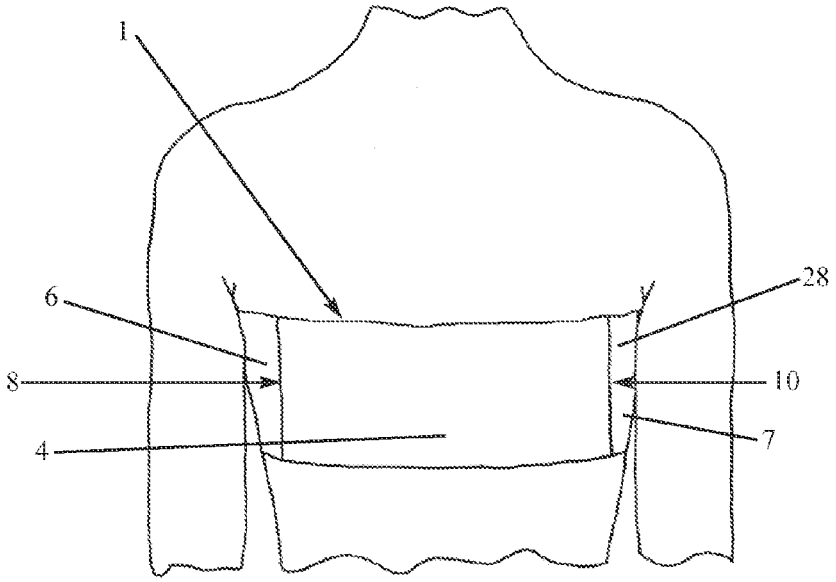
FIG. 10 is a front elevational view of a breast support device in accordance with a sixth embodiment of the present invention shown on the wearer.
Figure 11:
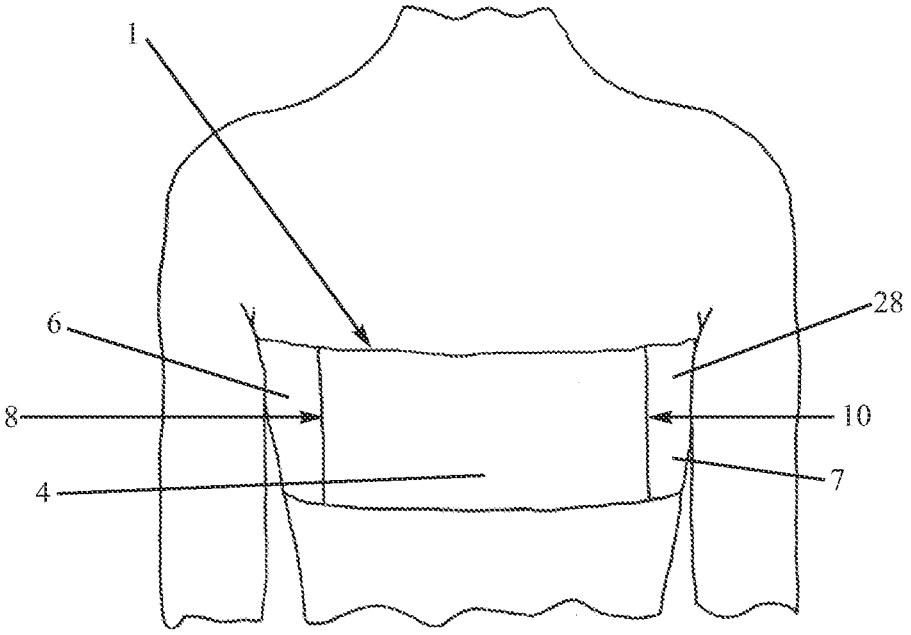
FIG. 11 is a front elevational view of a breast support device in accordance with a seventh embodiment of the present invention shown on the wearer.
Figure 12:
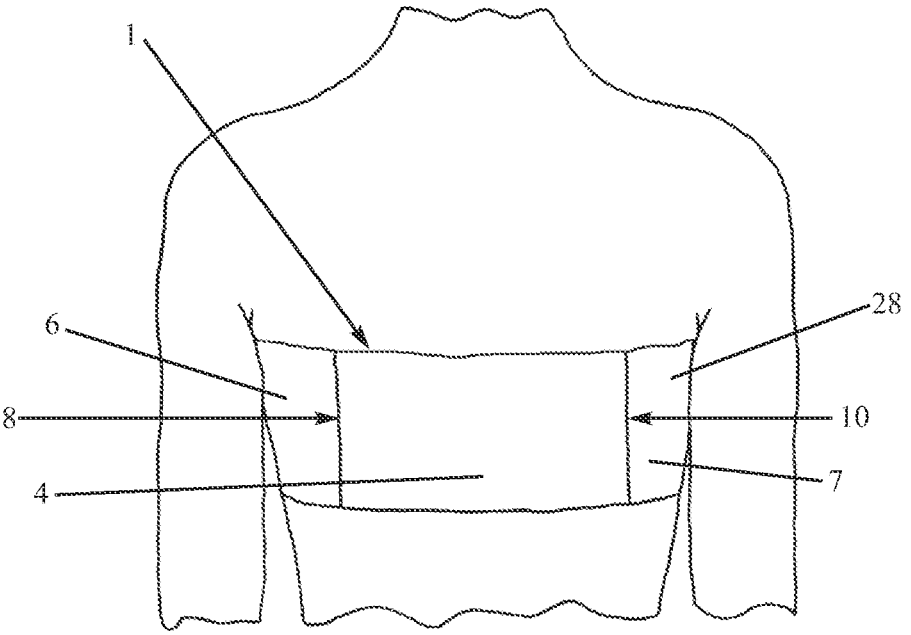
FIG. 12 is a front elevational view of a breast support device in accordance with an eighth embodiment of the present invention shown on the wearer.
Figure 13:
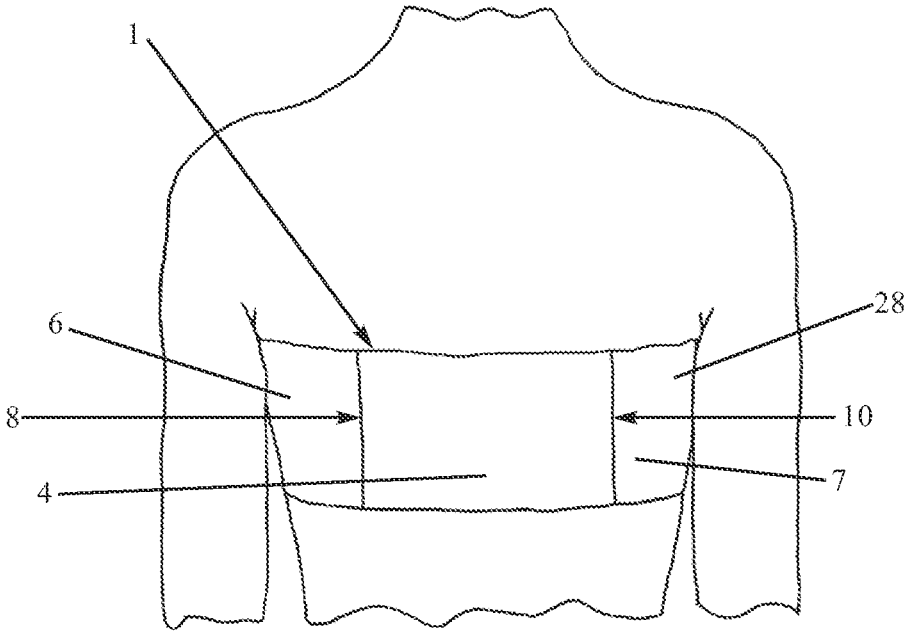
FIG. 13 is a front elevational view of a breast support device in accordance with a ninth embodiment of the present invention shown on the wearer.
Figure 14:
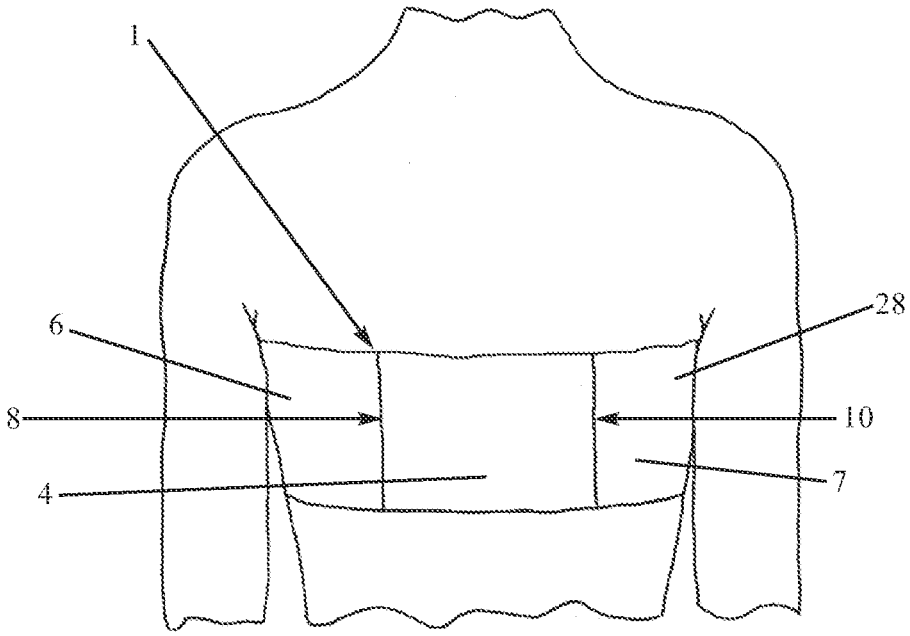
FIG. 14 is a front elevational view of a breast support device in accordance with a tenth embodiment of the present invention shown on the wearer.
Figure 15:
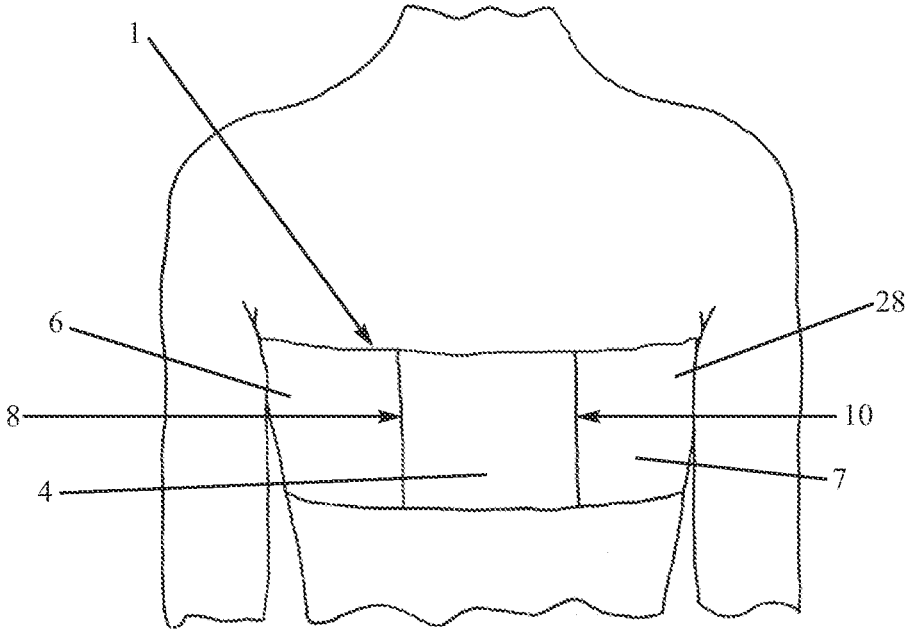
FIG. 15 is a front elevational view of a breast support device in accordance with an eleventh embodiment of the present invention shown on the wearer.
Figure 16:
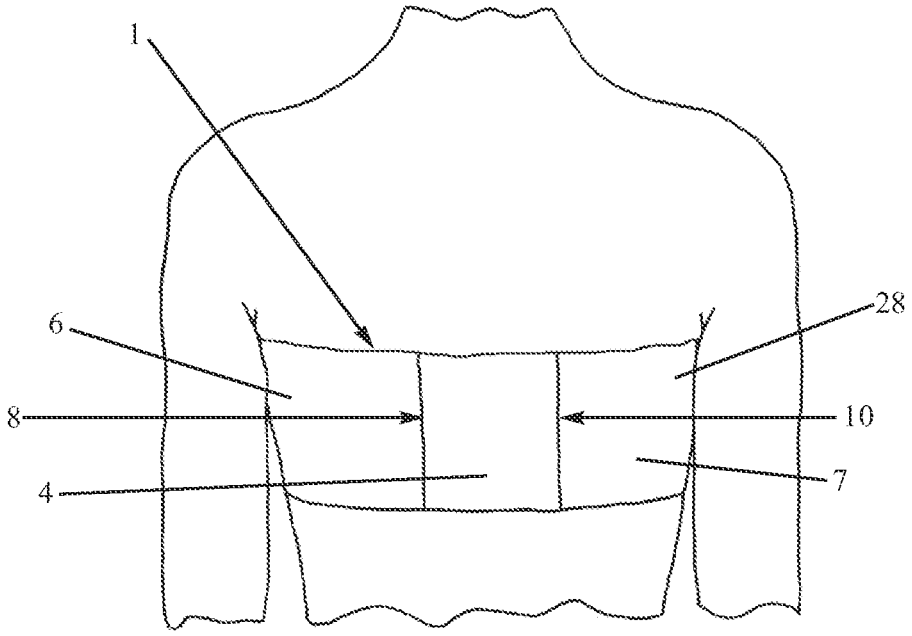
FIG. 16 is a front elevational view of a breast support device in accordance with a twelfth embodiment of the present invention shown on the wearer.
Figure 17:
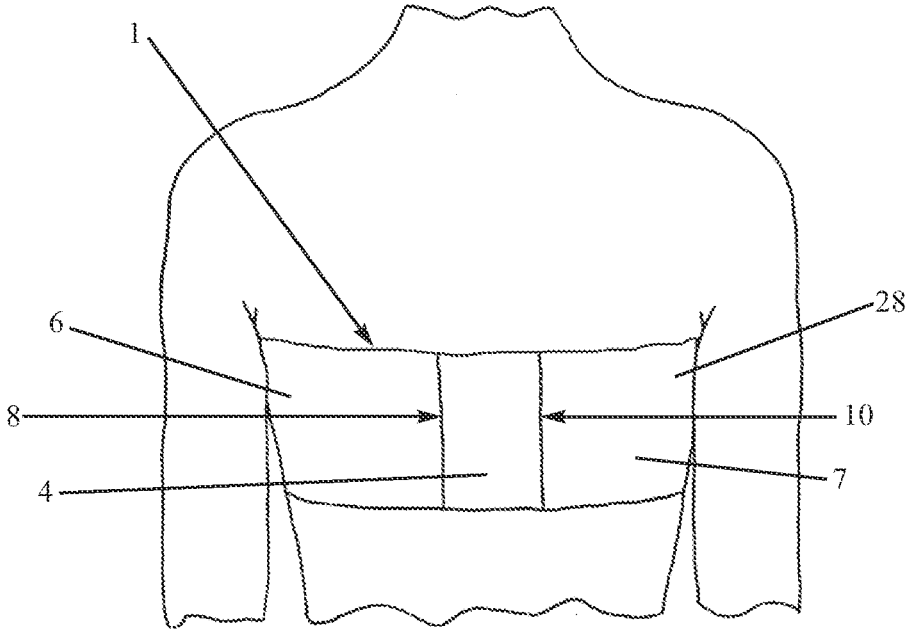
FIG. 17 is a front elevational view of a breast support device in accordance with a thirteenth embodiment of the present invention shown on the wearer.
Figure 18:
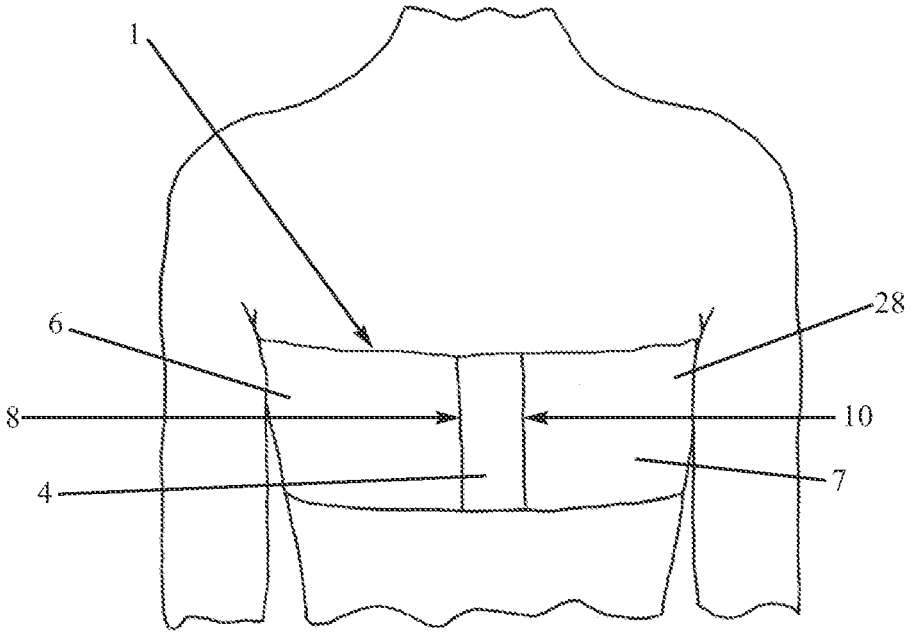
FIG. 18 is a front elevational view of a breast support device in accordance with a fourteenth embodiment of the present invention shown on the wearer.
Figure 19:
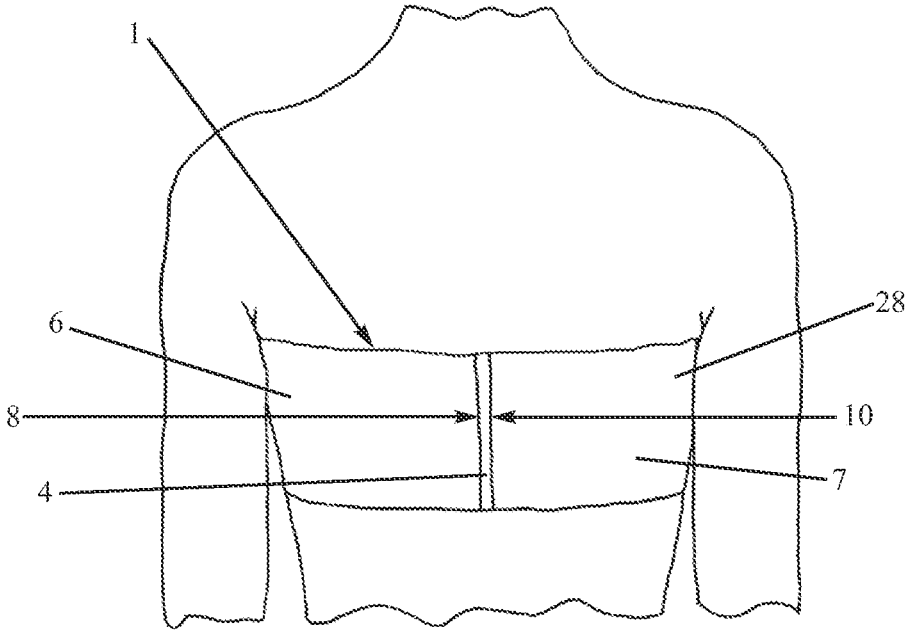
FIG. 19 is a front elevational view of a breast support device in accordance with a fifteenth embodiment of the present invention shown on the wearer.

Fabric pieces 6 and 28 extend over portions of each of the breast masses. Increasing the percentage of each breast mass covered by fabric pieces 6 and 28 can increase the control and support of the breast tissue. As shown in FIG. 10, in some embodiments, fabric pieces 6 and 28 may extend over approximately 1% to 10% of each breast mass. As shown in FIG. 11, in other embodiments, fabric pieces 6 and 28 may extend over approximately 10% to 20% of each breast mass. As shown in FIG. 12, in other embodiments, fabric pieces 6 and 28 may extend over approximately 20% to 30% of each breast mass. As shown in FIG. 13, in still other embodiments, fabric pieces 6 and 28 may extend over approximately 30% to 40% of each breast mass. As shown in FIG. 14, in other embodiments, fabric pieces 6 and 28 may extend over approximately 40% to 50% of each breast mass. As shown in FIG. 15, in other embodiments, fabric pieces 6 and 28 may extend over approximately 50% to 60% of each breast mass. As shown in FIG. 16, in other embodiments, fabric pieces 6 and 28 may extend over approximately 60% to 70% of each breast mass. As shown in FIG. 17, in other embodiments, fabric pieces 6 and 28 may extend over approximately 70% to 80% of each breast mass. As shown in FIG. 18, in other embodiments, fabric pieces 6 and 28 may extend over approximately 80% to 90% of each breast mass. As shown in FIG. 19, in other embodiments, fabric pieces 6 and 28 may extend over approximately 90% to 100% of each breast mass.

Fabric pieces 6 and 28 may also extend over portions of the wearer's back. Increasing the percentage of the wearer's back covered by fabric pieces 6 and 28 can increase the control and support of the breast tissue. In some embodiments, fabric pieces 6 and 28 may extend over approximately 1% to 10% of the wearer's back. In other embodiments, fabric pieces 6 and 28 may extend over approximately 10% to 20% of the wearer's back. In other embodiments, fabric pieces 6 and 28 may extend over approximately 20% to 30% of the wearer's back. In still other embodiments, fabric pieces 6 and 28 may extend over approximately 30% to 40% of the wearer's back. In other embodiments, fabric pieces 6 and 28 may extend over approximately 40% to 50% of the wearer's back. In other embodiments, fabric pieces 6 and 28 may extend over approximately 50% to 60% of the wearer's back. In other embodiments, fabric pieces 6 and 28 may extend over approximately 60% to 70% of the wearer's back. In other embodiments, fabric pieces 6 and 28 may extend over approximately 70% to 80% of the wearer's back. In other embodiments, fabric pieces 6 and 28 may extend over approximately 80% to 90% of the wearer's back.

The front center panel 4 and back center panel 5 of the breast support device 1 are constructed of a stretch material. When used herein, "stretch material," means a material where the spandex content of the stretch material affects the level of support of the breast support device, with a higher spandex content corresponding to a higher recovery power, with a higher recovery power requiring more energy to pull apart, thereby providing a greater amount of support. In further embodiments, the front center panel 4 and back center panel 5 of the breast support device 1 may contain from approximately 1% to 5% spandex. In even further embodiments, the front center panel 4 and back center panel 5 of the breast support device 1 may contain approximately 5% to 10% spandex. In further embodiments, the front center panel 4 and back center panel 5 of the breast support device 1 may contain approximately 10% to 15% spandex. In even further embodiments, the front center panel 4 and back center panel 5 of the breast support device 1 may contain approximately 15% to 20% spandex. In further embodiments, the front center panel 4 and back center panel 5 of the breast support device 1 may contain approximately 20% to 25% spandex. In even further embodiments, the front center panel 4 and back center panel 5 of the breast support device 1 may contain approximately 25% to 30% spandex. In even further embodiments, the front center panel 4 and back center panel 5 of the breast support device 1 may contain approximately 30% to 35% spandex. In further embodiments, the front center panel 4 and back center panel 5 of the breast support device 1 may contain approximately 35% to 40% spandex.

In some embodiments, the other material in the front center panel 4 and back center panel 5 of the breast support device 1 may be nylon. In other embodiments, the other material in the front center panel 4 and back center panel 5 of the breast support device 1 may be polyester. In other embodiments, the other material in the front center panel 4 and back center panel 5 of the breast support device 1 may be cotton. In still other embodiments, the other material in the front center panel 4 and back center panel 5 of the breast support device 1 may be wool. In other embodiments, the other material in the front center panel 4 and back center panel 5 of the breast support device 1 may be silk. In other embodiments, the other material in the front center panel 4 and back center panel 5 of the breast support device 1 may be acrylic. In other embodiments, the other material in the front center panel 4 and back center panel 5 of the breast support device 1 may be acetate. In still other embodiments, the other material in the front center panel 4 and back center panel 5 of the breast support device 1 may be rayon. In still other embodiments, the other material in the front center panel 4 and back center panel 5 of the breast support device 1 may be a combination of two or more of these materials.

Figure 20:
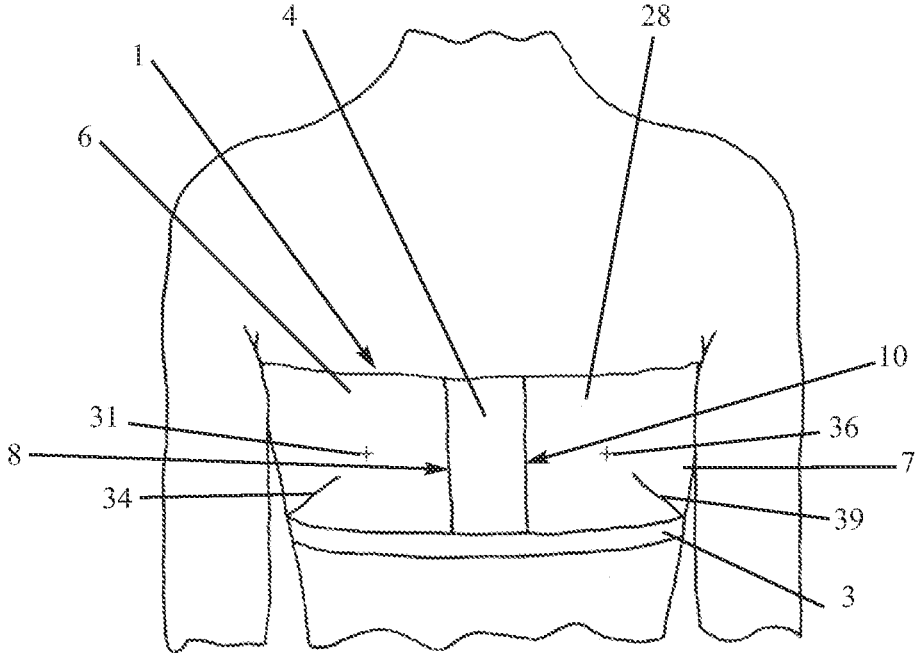
FIG. 20 is a front elevational view of a breast support device in accordance with a sixteenth embodiment of the present invention shown on the wearer.
Figure 21:
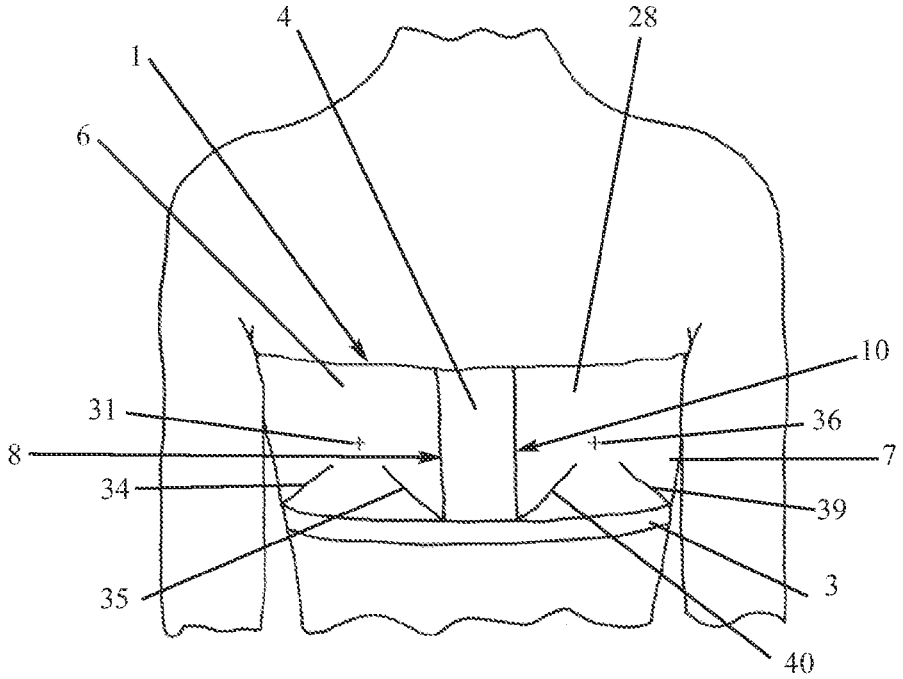
FIG. 21 is a front elevational view of a breast support device in accordance with a seventeenth embodiment of the present invention shown on the wearer.
Figure 22:
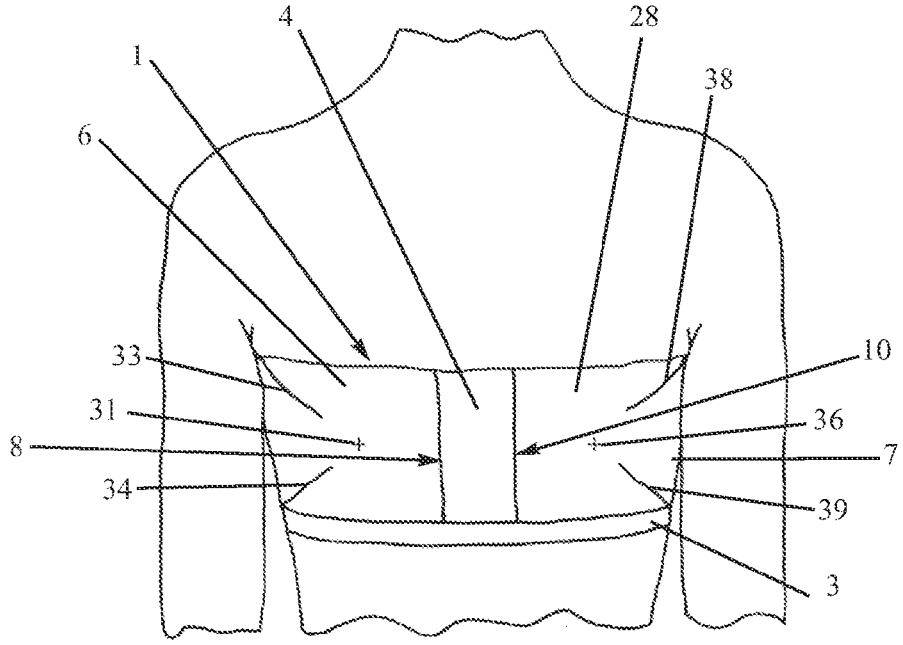
FIG. 22 is a front elevational view of a breast support device in accordance with an eighteenth embodiment of the present invention shown on the wearer.
Figure 23:
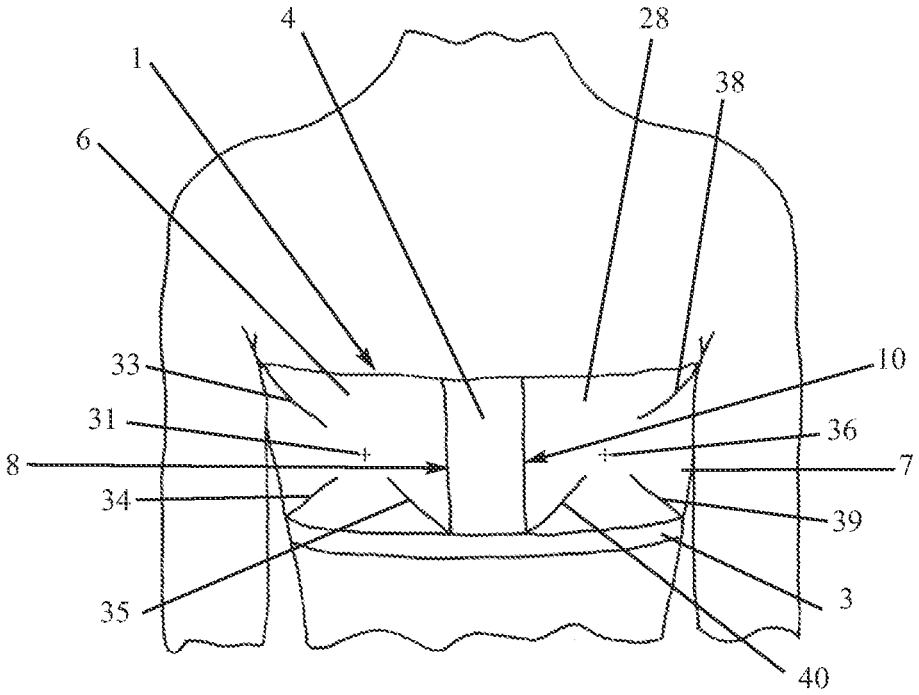
FIG. 23 is a front elevational view of a breast support device in accordance with a nineteenth embodiment of the present invention shown on the wearer.
Figure 24:
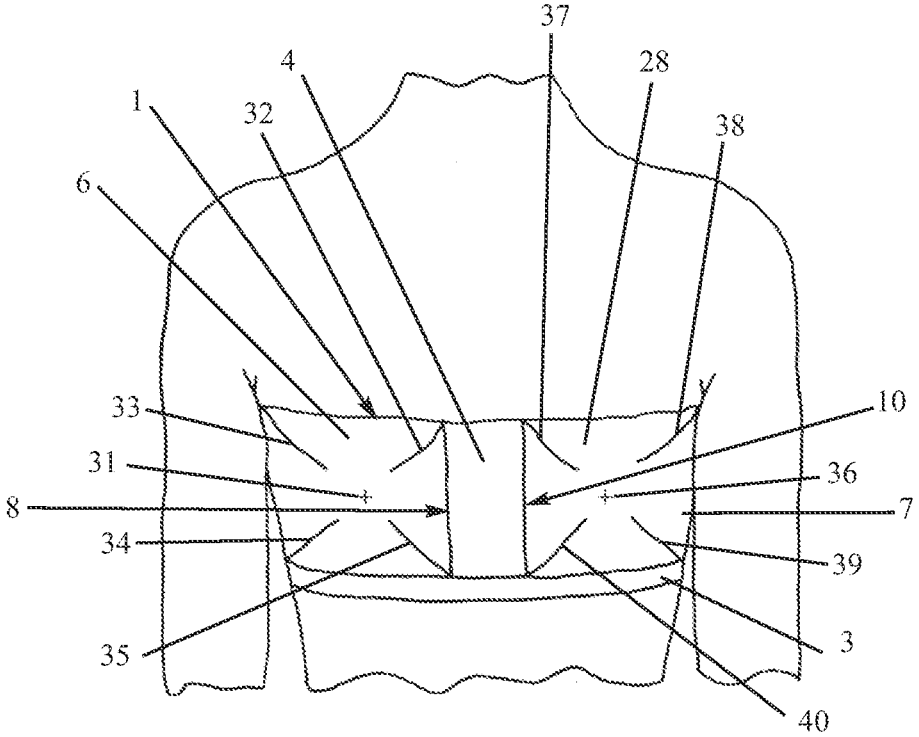
FIG. 24 is a front elevational view of a breast support device in accordance with a twentieth embodiment of the present invention shown on the wearer.

FIG. 20 shows a further embodiment, where the fabric pieces 6, 28 may each include a dart 34, 39 such that each dart 34, 39 is oriented toward the center portion 31, 36 of the wearer's breast. FIG. 21 and FIG. 22 show other embodiments, where the fabric pieces 6, 28 may each include two darts 34, 35, 39, 40 and 33, 34, 38, 40 such that each dart 34, 35, 39, 40 and 33, 34, 38, 40 is oriented toward the center portion 31, 36 of the wearer's breast. FIG. 23 shows other embodiments, where the fabric pieces 6, 28 may each include three darts 33, 34, 35, 38, 39, 40 such that each dart 33, 34, 35, 38, 39, 40 is oriented toward the center portion 31, 36 of each breast. FIG. 24 shows still further embodiments, where the fabric pieces 6, 28 may each include four darts 32, 33, 34, 35, 37, 38, 39, 40 such that each dart 32, 33, 34, 35, 37, 38, 39, 40 is oriented toward the center point 31, 36 of each breast.

Figure 25:
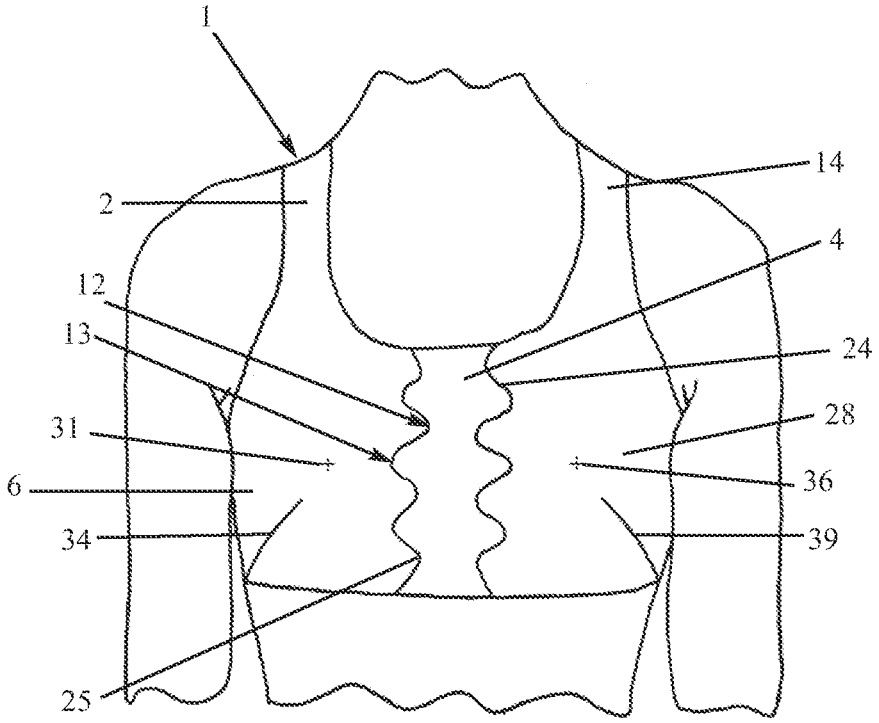
FIG. 25 is a front elevational view of a breast support device in accordance with a twenty-first embodiment of the present invention shown on the wearer.
Figure 26:
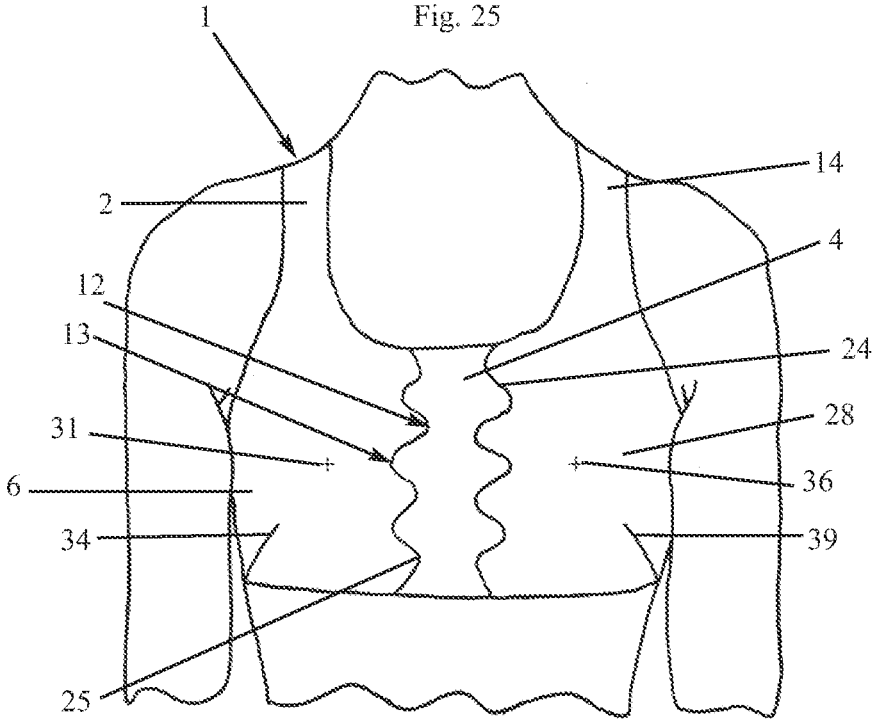
FIG. 26 is a front elevational view of a breast support device in accordance with a twenty-second embodiment of the present invention shown on the wearer.
Figure 27:
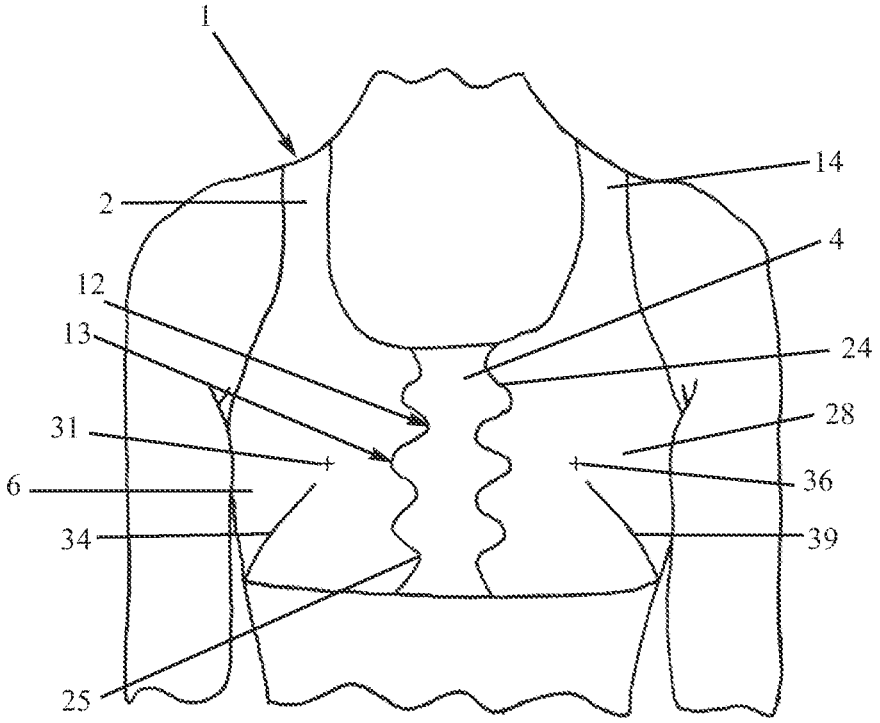
FIG. 27 is a front elevational view of a breast support device in accordance with a twenty-third embodiment of the present invention shown on the wearer.

In other embodiments of the present invention as shown in FIG. 25, the darts 34, 39 may be each approximately three to four inches in length. Darts of this length can assist in creating a three-dimensional space in the non-stretch fabric to receive a breast in the approximate size range of C-cup through DDD-cup. It is understood by those skilled in the art that increasing or decreasing the width of the dart can also increase or decrease the size of the three-dimensional space in the non-stretch fabric. In other embodiments of the present invention as shown in FIG. 26, the darts 34, 39 may be each approximately one to two inches in length. It is contemplated that darts of this length can assist in creating a three-dimensional space in the non-stretch fabric to receive a breast in the approximate size range of A-cup through C-cup. Increasing or decreasing the width of the dart can also increase or decrease the size of the three-dimensional space in the non-stretch fabric. In still other embodiments of the present invention as shown in FIG. 27, the darts 34, 39 may be each approximately five to six inches in length. Darts of this length can assist in creating a three-dimensional space in the non-stretch fabric to receive a breast in the approximate size range of DDD-cup through J-cup. Increasing or decreasing the width of the dart can also increase or decrease the size of the three-dimensional space in the non-stretch fabric. A dart with a length of less that one inch may be utilized to assist in creating a three-dimensional space in the non-stretch fabric to receive a breast of a size of approximately A-cup or smaller. Increasing or decreasing the width of the dart can also increase or decrease the size of the three-dimensional space in the non-stretch fabric. A dart with a length greater than six inches or lengths greater that six inches may be utilized to assist in creating a three-dimensional space in the non-stretch fabric to receive a breast of a size of approximately J-cup or larger. Increasing or decreasing the width of the dart can also increase or decrease the size of the three-dimensional space in the non-stretch fabric.

Figure 28:
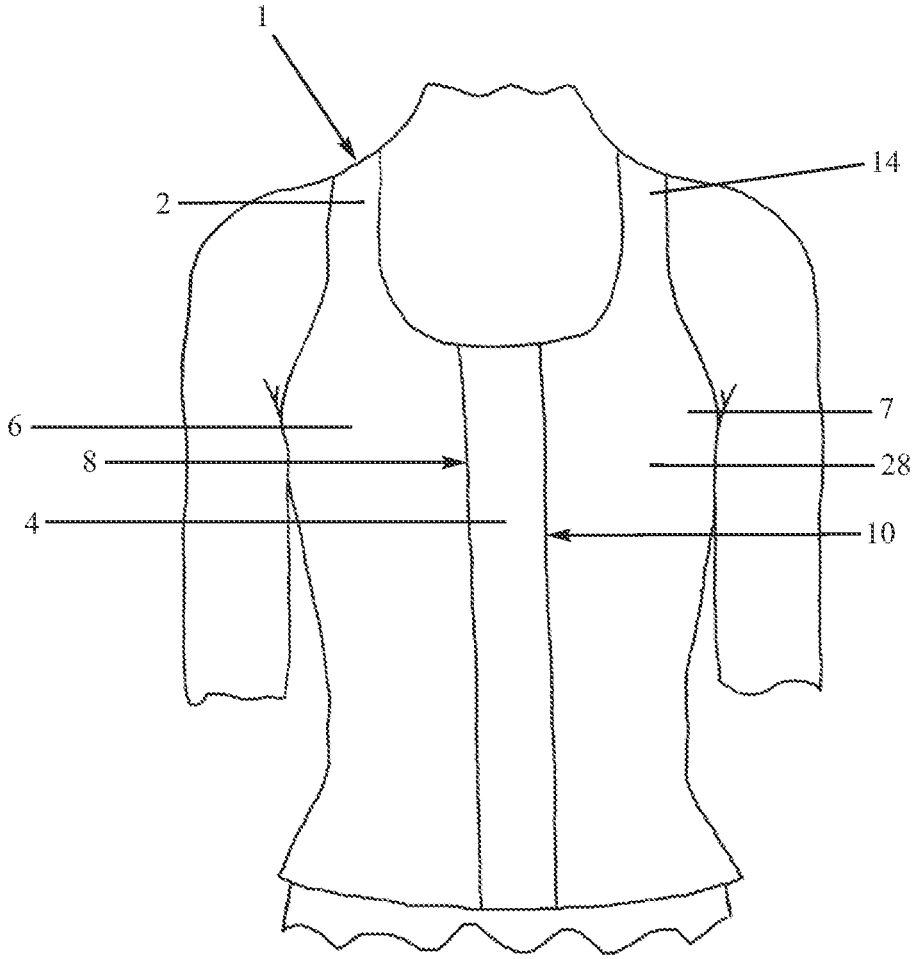
FIG. 28 is a front elevational view of a breast support device in accordance with a twenty-fourth embodiment of the present invention shown on the wearer.
Figure 29:
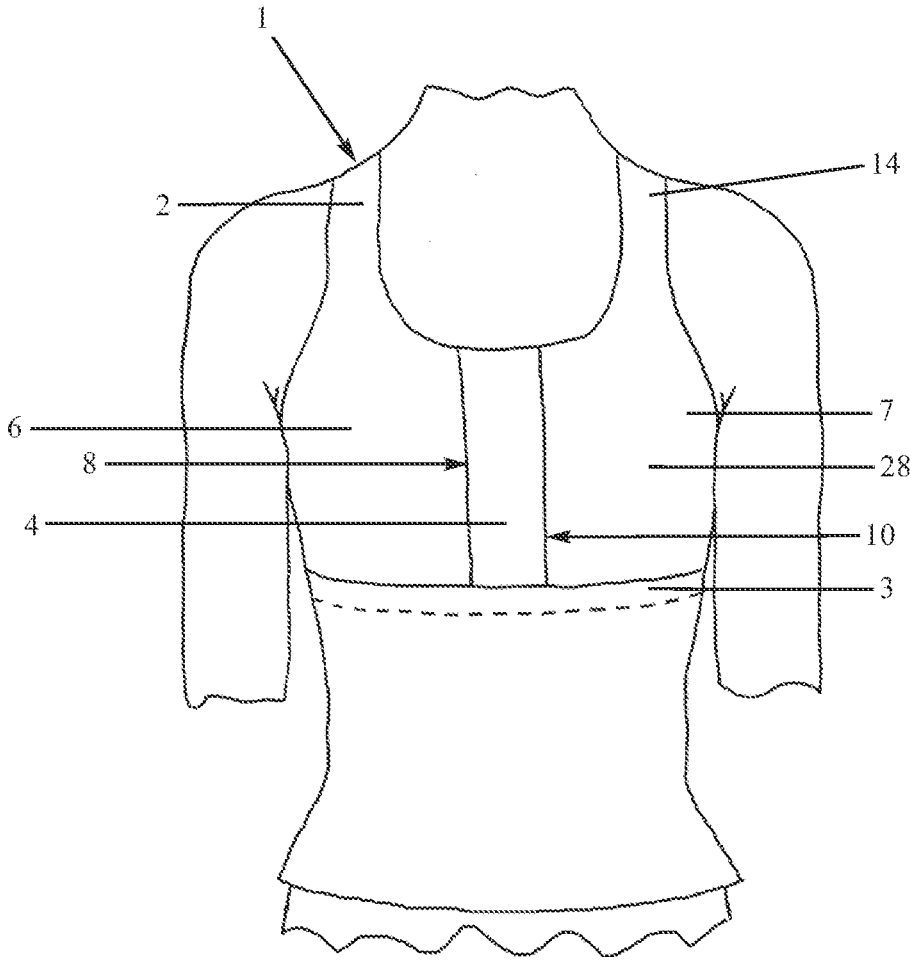
FIG. 29 is a front elevational view of a breast support device in accordance with a twenty-fifth embodiment of the present invention shown on the wearer.

FIG. 28 and FIG. 29 show still further embodiments, where the breast support device 1 can be integrated into a portion of a garment associated with the breasts, upper back and shoulders of the wearer.

Figure 30:
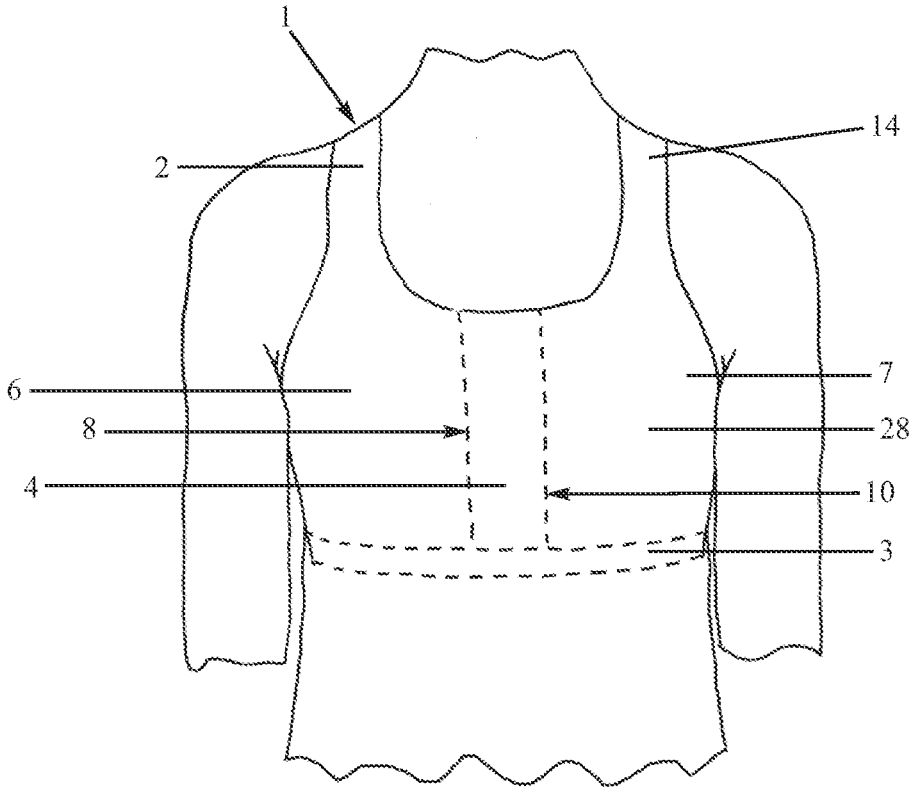
FIG. 30 is a front elevational view of a breast support device in accordance with a twenty-sixth embodiment of the present invention shown on the wearer.
Figure 31:
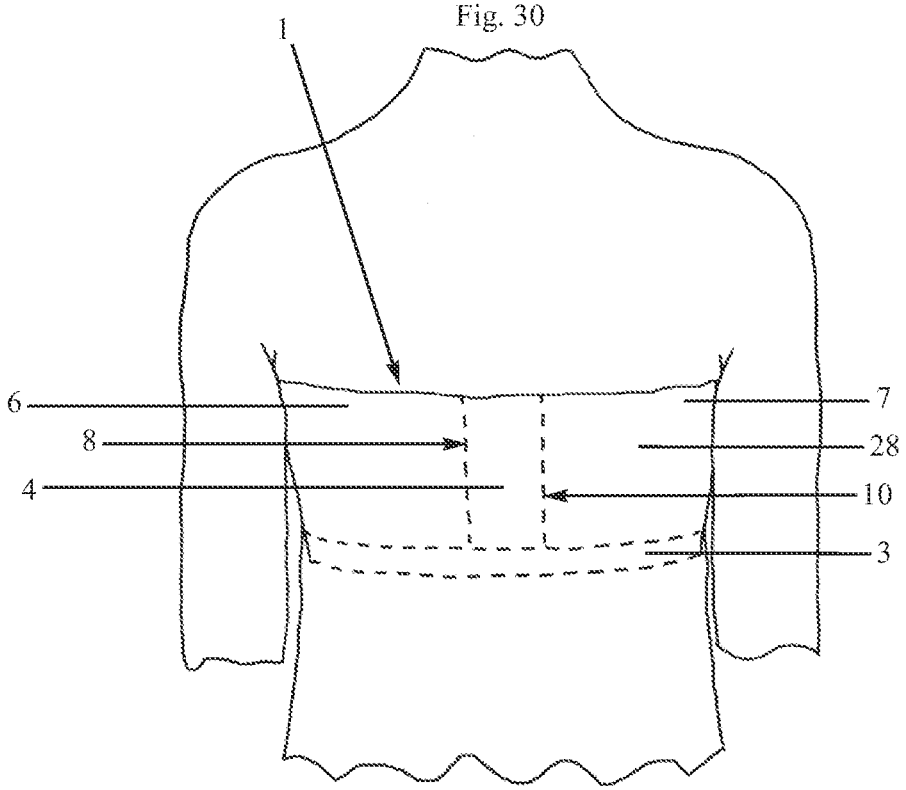
FIG. 31 is a front elevational view of a breast support device in accordance with a twenty-seventh embodiment of the present invention shown on the wearer.

FIG. 30 and FIG. 31 show further embodiments, where the breast support device 1 can be integrated into the lining of a garment, such that the breast support device 1 is connected to the interior of the garment at the side seams of the garment or at the shoulder seams of the garment.

Figure 32:
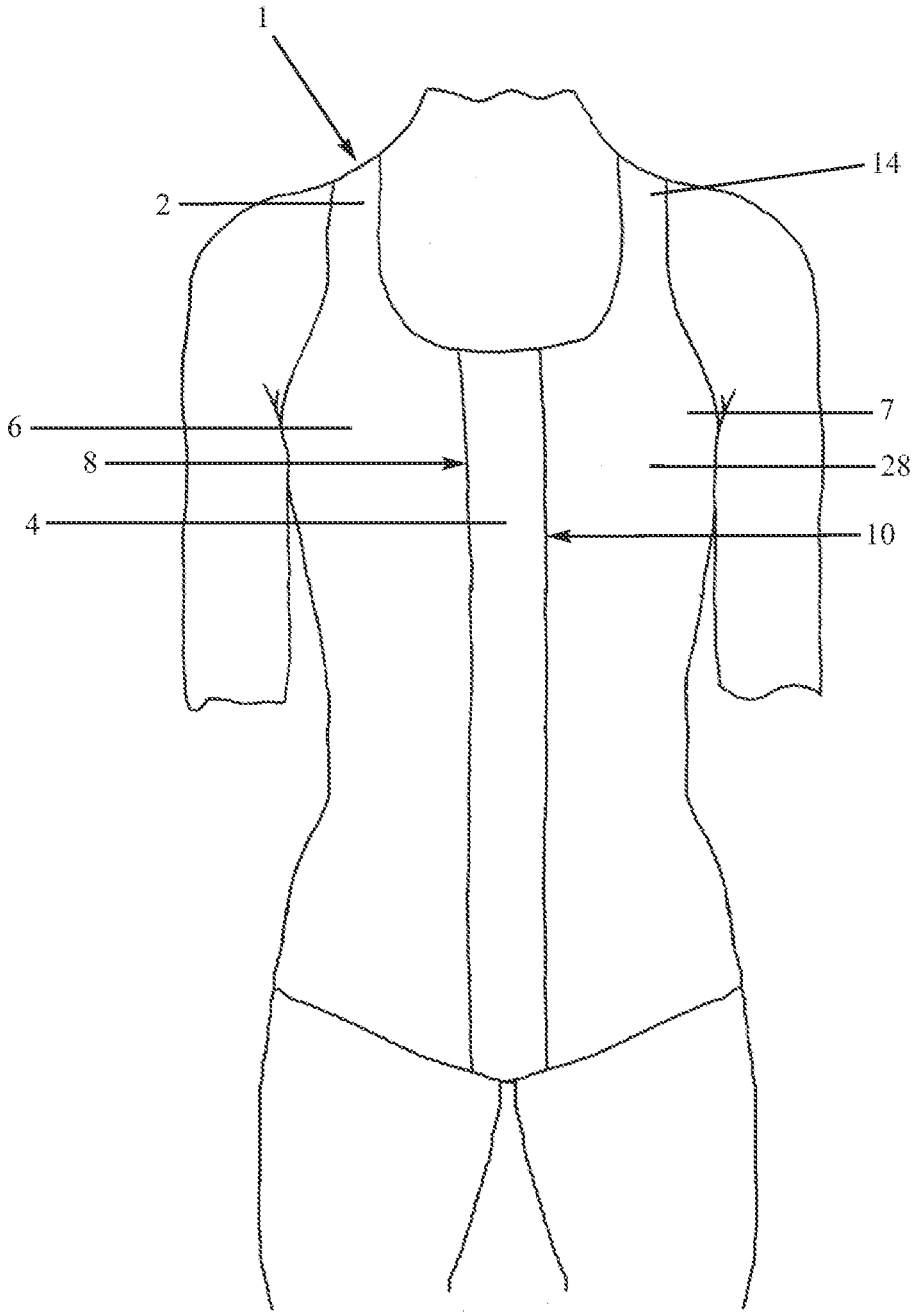
FIG. 32 is a front elevational view of a breast support device in accordance with a twenty-eighth embodiment of the present invention shown on the wearer.
Figure 33:
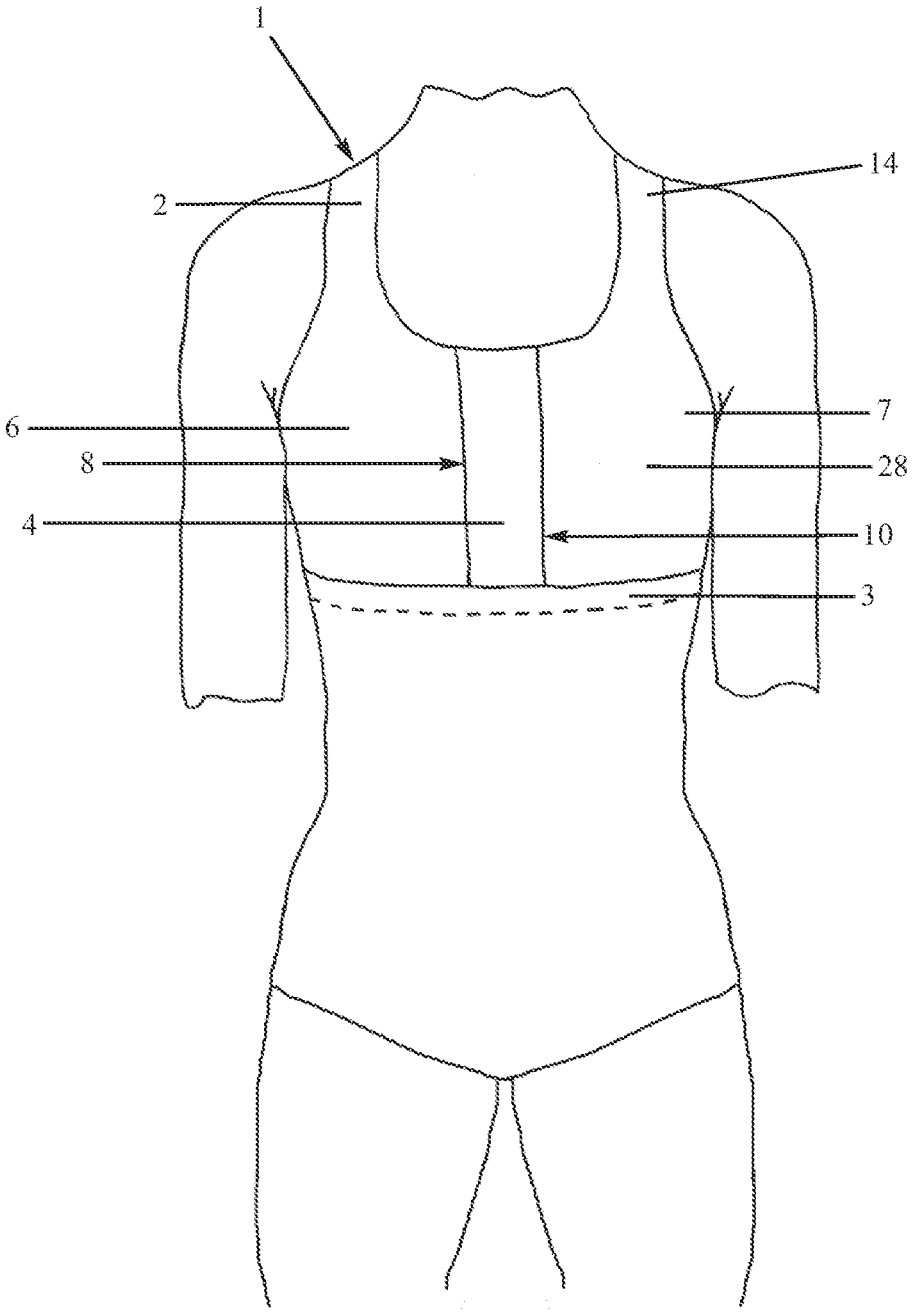
FIG. 33 is a front elevational view of a breast support device in accordance with a twenty-ninth embodiment of the present invention shown on the wearer.

FIG. 32 and FIG. 33 show further embodiments, where the breast support device 1 can be integrated into a bathing suit or unitard.

Figure 34:
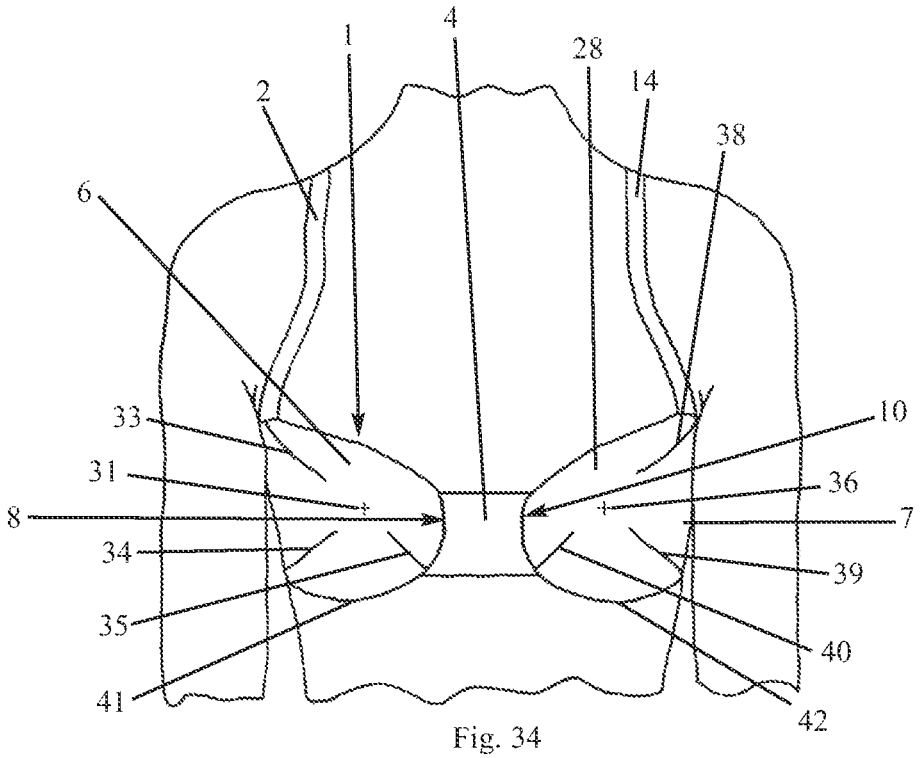
FIG. 34 is a front elevational view of a breast support device in accordance with a thirtieth embodiment of the present invention shown on the wearer.

FIG. 34 shows still further embodiments, where the breast support device 1 can be integrated into a conventional underwire bra, such that an underwire is integrated into the bottom portion 41, 42 of each non-stretch panel 6, 28 associated with the breast tissue.

Figure 35:
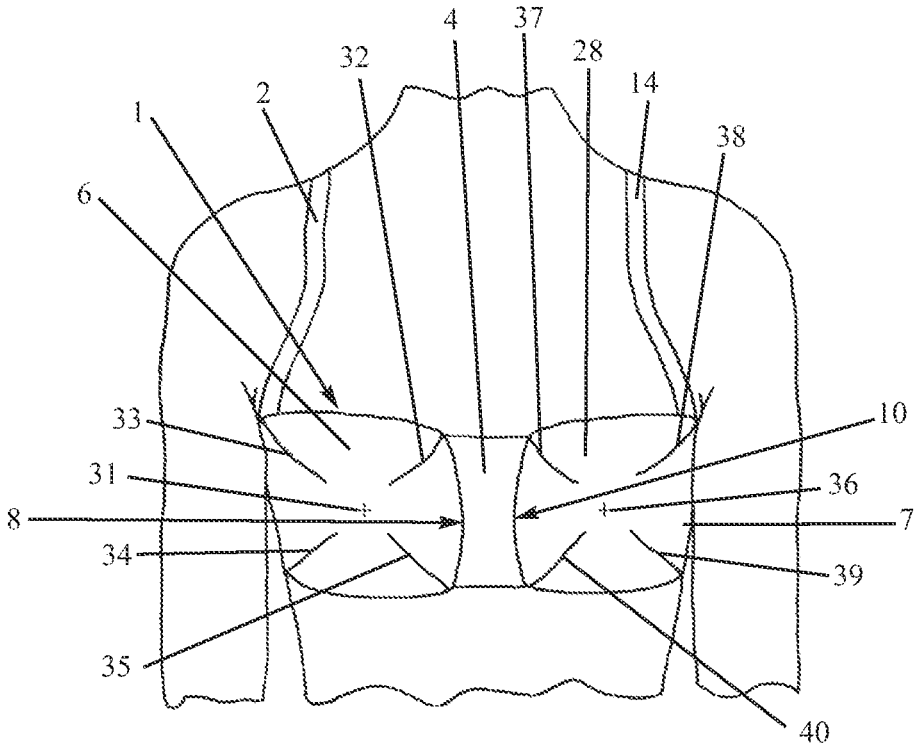
FIG. 35 is a front elevational view of a breast support device in accordance with a thirty-first embodiment of the present invention shown on the wearer.

FIG. 35 shows further embodiments, where the breast support device 1 can be integrated into a conventional non-underwire bra.

Figure 36:
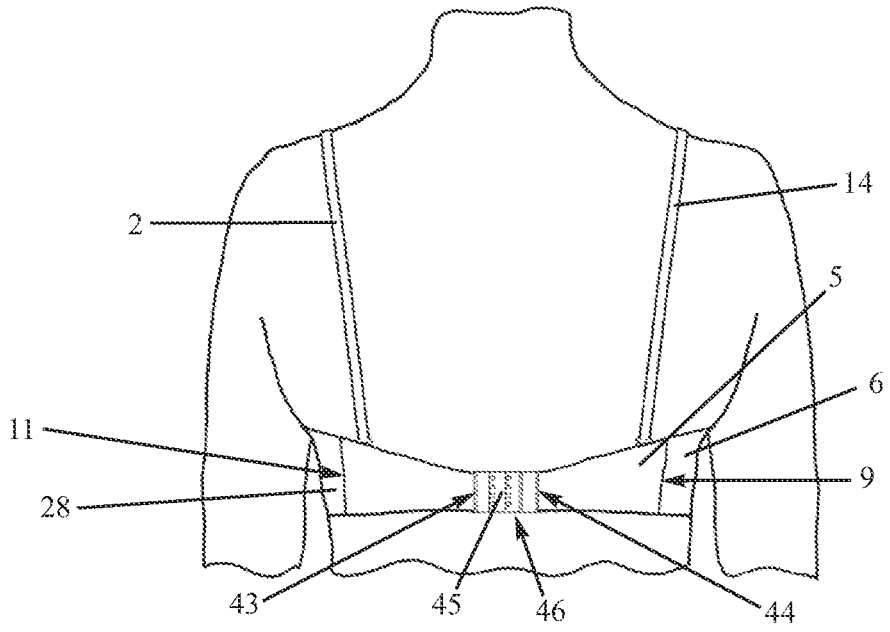
FIG. 36 is a rear elevational view of a breast support device in accordance with a thirty-second embodiment of the present invention showing a back center panel incorporating an adjustable fastening system.
Figure 37:
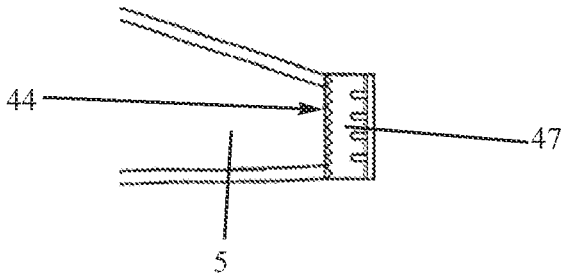
FIG. 37 is a view of a series of hooks utilized in an adjustable fastening system according to FIG. 36.

In further embodiments as shown in FIG. 36 and FIG. 37, the back stretch panel 5 may incorporate an adjustment fastening system 46. The adjustment fastening system 46 may include a series of hooks 47 and eyes 45 associated with the left and right terminal ends 43, 44 of the back stretch panel 5. In other embodiments of the present invention, the adjustment fastening system may include any kind of adjustment fastening system known in the art, such as Velcro, buttons, zippers, snaps, slides or buckles.

In still further embodiments, the stretch fabric used for the back center panel 5 and/or front center panel 4 of the bra is a stretch mesh fabric. The use of a stretch mesh fabric can provide a high degree of ventilation and moisture management without sacrificing motion control of the breast tissue.

Figure 38:
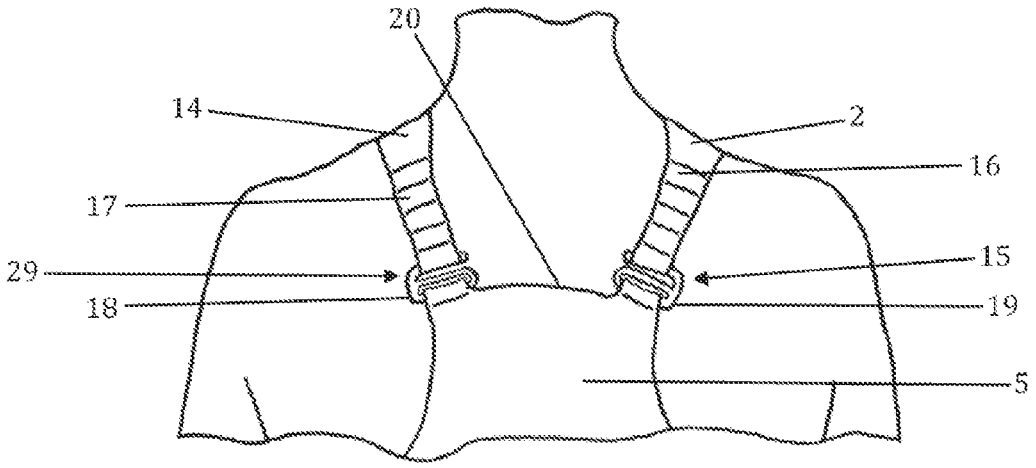
FIG. 38 is a rear elevational view of a breast support device in accordance with a thirty-third embodiment of the present invention showing shoulder straps incorporating an adjustable fastening system.
Figure 39:
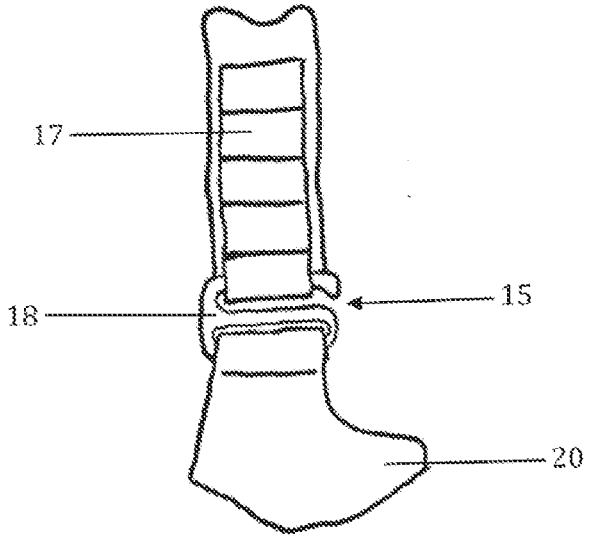
FIG. 39 is a view of an adjustable fastening system according to FIG. 38.

In further embodiments, the shoulder straps 2 and 14 may include an adjustment fastening system 15 and 29. In the embodiment shown in FIG. 38 and FIG. 39, the adjustment fastening system 15 and 29 may include a series of slots 16 and 17 associated with each of the shoulder straps. Adjustment hooks 18 and 19 can be associated with the top edge 20 of the back center panel 5. The adjustment hooks 18 and 19 can be horizontally oriented so that they can be received in adjustment slots 16 and 17.

In still further embodiments, the adjustment fastening system 15 and 29 may include any kind of adjustment fastening system known in the art, such as Velcro, hook-and-eye, buttons, zippers, snaps, slides or buckles.

Figure 40:
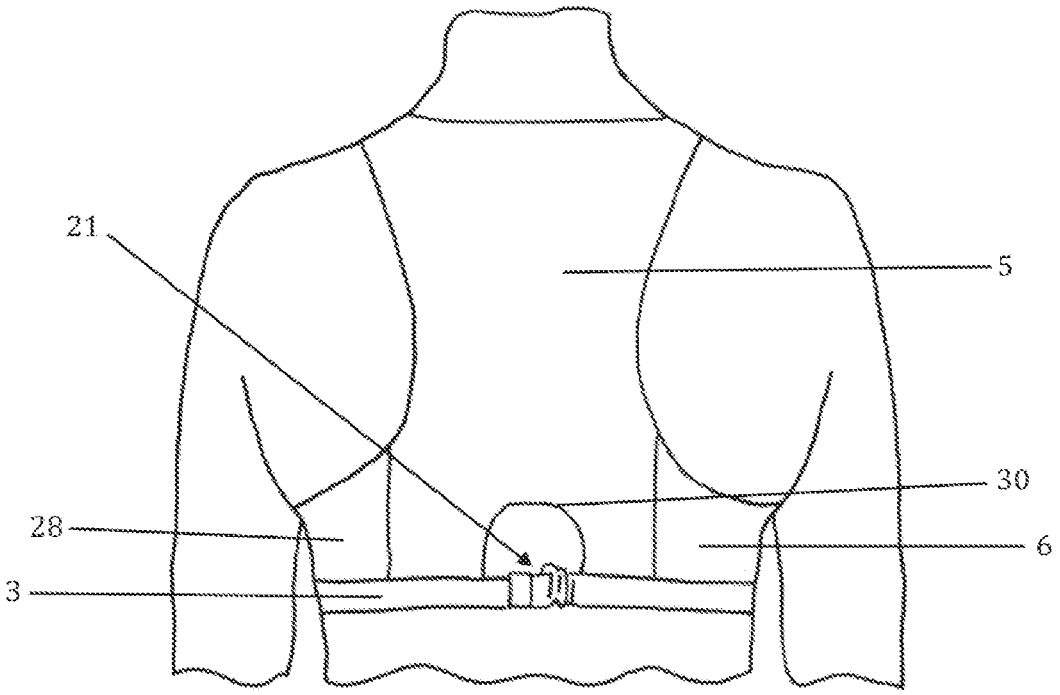
FIG. 40 is a rear elevational view of a breast support device in accordance with a thirty-fourth embodiment of the present invention showing a rib band incorporating an adjustable fastening system.
Figure 41:
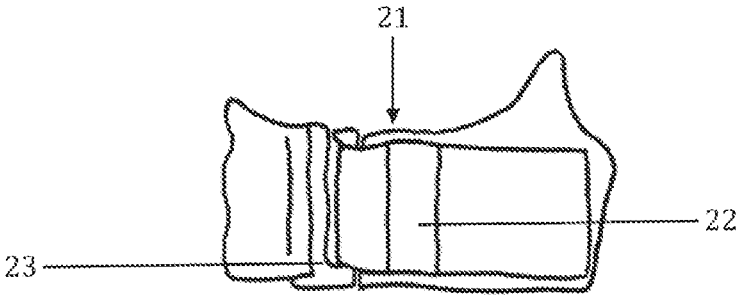
FIG. 41 is a view of an adjustable fastening system according to FIG. 40.

In other embodiments of the present invention, the rib band 3 may include an adjustment fastening system 21. In the embodiment shown in FIG. 40 and FIG. 41, the adjustment fastening system may include a series of slots 22 associated with the rib band 3. An adjustment hook 23 may be associated with one end of the rib band 3. The adjustment hook 23 may be vertically oriented so that they can be received in adjustment slots 22. The back center panel 5 may have a keyhole cutout 30 to accommodate adjustments made in the rib band 3.

In other embodiments of the present invention, the adjustment fastening system 21 may include any kind of adjustment fastening system known in the art, such as Velcro, hook-and-eye, buttons, zippers, snaps, slides or buckles.

While various embodiments have been described, it will be apparent to those of ordinary skill in the art that more embodiments and implementations are possible that are within the scope of the invention.

What is claimed:

1. A breast support device comprising:

a front center panel constructed of stretch material, the front center panel substantially centered on a wearer's torso when the breast support device is worn;

a back center panel constructed of stretch material, the back center panel substantially centered on a wearer's torso when the breast support device is worn;

the left edge of the front center panel and the right edge of the back center panel connected to one another by one or more contiguous fabric pieces constructed of non-stretch material, the one or more contiguous fabric pieces forming a left side panel of the breast support device, the right edge of the front center panel and the left edge of the back center panel connected to one another by one or more contiguous fabric pieces constructed of non-stretch material the one or more contiguous fabric pieces forming a right side panel of the breast support device; and a shoulder strap connected to one of the front center panel, the back center panel, the left side panel and the right side panel.

2. The breast support device of claim 1, wherein at least one portion of the stretch fabric used for the body is mesh.

3. The breast support device of claim 1, wherein the back stretch panel incorporates an adjustable fastening system.

4. The breast support device of claim 3, wherein at least one portion of the stretch fabric used for the body is mesh.

5. The breast support device of claim 1 further comprising a rib band attached to one of the front center panel, the back center panel, the left side panel and the right side panel.

6. The breast support device of claim 5, wherein said rib band incorporates an adjustable fastening system.

7. The breast support device of claim 5, wherein at least one portion of the stretch fabric used for the body is mesh.

8. The breast support device of claim 7, wherein said rib band incorporates an adjustable fastening system.

9. The breast support device of claim 1 further comprising a plurality of shoulder straps, each of the plurality of shoulder straps connected to one of the front center panel, the back center panel, the left side panel and the right side panel.

10. The breast support device of claim 9, wherein at least one of the plurality of shoulder straps incorporates an adjustable fastening system.

11. The breast support device of claim 9, wherein at least one portion of the stretch fabric used for the body is mesh.

12. The breast support device of claim 9, wherein the back stretch panel incorporates an adjustable fastening system.

13. The breast support device of claim 10, wherein at least one portion of the stretch fabric used for the body is mesh.

14. The breast support device of claim 13 wherein the back stretch panel incorporates an adjustable fastening system.

15. The breast support device of claim 9, wherein the back stretch panel incorporates an adjustable fastening system.

16. The breast support device of claim 10, wherein the back stretch panel incorporates and adjustable fastening system.

17. The breast support device of claim 9, further comprising a rib band attached to one of the front center panel, the back center panel, the left side panel and the right side panel.

18. The breast support device of claim 17, wherein said rib band incorporates an adjustable fastening system.

19. The breast support device of claim 17, wherein at least one portion of the stretch fabric used for the body is mesh.

20. The breast support device of claim 19, wherein said rib band incorporates an adjustable fastening system.

21. The breast support device of claim 17, wherein at least one of the plurality of shoulder straps incorporates an adjustable fastening system.

22. The breast support device of claim 21, wherein at least one portion of the stretch fabric used for the body is mesh.

23. The breast support device of claim 21, wherein said rib band incorporates an adjustable fastening system.

24. The breast support device of claim 22, wherein said rib band incorporates an adjustable fastening system.

25. The breast support device of claim 1 wherein said contiguous fabric pieces constructed of non-stretch material include one or more darts oriented toward the center portion of the wearer's breast.

26. The breast support device of claim 1 wherein the border between stretch fabric pieces and non-stretch fabric pieces is irregular.

27. The breast support device of claim 1 wherein said contiguous fabric pieces constructed of non-stretch material include one or more darts oriented toward the center portion of the wearer's breast, and wherein the border between stretch fabric pieces and non-stretch fabric pieces is irregular.

28. An article of swimwear incorporating the breast support device of claim 1.

29. A unitard incorporating the breast support device of claim 1.

30. A bra incorporating the breast support device of claim 1.

31. The bra of claim 30 wherein the bra comprises a conventional underwire bra.

32. An outerwear garment comprising the breast support device of claim 1.

33. A method for making a breast support device comprising:

providing a front center panel constructed of stretch material and having a left edge and a right edge and configured to be substantially centered on a wearer's torso when the breast support device is worn;

providing a back center panel constructed of stretch material and having a left edge and a right edge and configured to be substantially centered on a wearer's torso when the breast support device is worn;

providing a first fabric piece constructed of non-stretch material;

connecting the left edge of the front center panel to the right edge of the back center panel using the first fabric piece to form a first side panel of the breast support device;

providing a second fabric piece constructed of non-stretch material;

connecting the right edge of the front center panel to the left edge of the back center panel using the second fabric piece to form a second side panel of the breast support device;

providing a shoulder strap; and connecting the shoulder strap to one of the front center panel, the back center panel, the left side panel and the right side panel.

34. The method of claim 33, further comprising:

providing a rib band configured to encircle a wearer's torso; and connecting the rib band to one of the front center panel, the back center panel, the first side panel and the second side panel.

35. The method of claim 34, wherein providing the rib band comprises providing a rib band incorporating an adjustable fastening system.

36. The method of claim 33, wherein providing the front center panel comprises providing a front center panel comprising mesh.

37. The method of claim 33 wherein connecting the left edge of the front center panel to the right edge of the back center panel comprises connecting the left edge of the front center panel to the right edge of the back center panel using an irregular seam.

38. The method of claim 33 wherein connecting the right edge of the front center panel to the left edge of the back center panel comprises connecting the right edge of the front center panel to the left edge of the back center panel using an irregular seam.

* * * * *